US010704486B2

(12) United States Patent
Kusakabe et al.

(10) Patent No.: US 10,704,486 B2
(45) Date of Patent: Jul. 7, 2020

(54) DRIVE DEVICE FOR FUEL INJECTION DEVICE

(71) Applicant: HITACHI AUTOMOTIVE SYSTEMS, LTD., Hitachinaka-shi, Ibaraki (JP)

(72) Inventors: Ryo Kusakabe, Hitachinaka (JP); Takatoshi Iizuka, Hitachinaka (JP); Takao Miyake, Hitachinaka (JP); Masashi Sugaya, Hitachinaka (JP); Kiyotaka Ogura, Hitachinaka (JP); Shirou Yamaoka, Hitachinaka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 464 days.

(21) Appl. No.: 15/546,432

(22) PCT Filed: Feb. 1, 2016

(86) PCT No.: PCT/JP2016/052853
§ 371 (c)(1),
(2) Date: Jul. 26, 2017

(87) PCT Pub. No.: WO2016/136394
PCT Pub. Date: Sep. 1, 2016

(65) Prior Publication Data

US 2018/0017005 A1 Jan. 18, 2018

(30) Foreign Application Priority Data

Feb. 27, 2015 (JP) ..... 2015-037614

(51) Int. Cl.
*F02D 41/20* (2006.01)
*F02M 61/10* (2006.01)
(Continued)

(52) U.S. Cl.
CPC ..... *F02D 41/20* (2013.01); *F02D 41/26* (2013.01); *F02D 41/307* (2013.01);
(Continued)

(58) Field of Classification Search
CPC ..... F02D 41/20; F02D 41/26; F02D 41/3064; F02D 41/307; F02D 2041/2041;
(Continued)

(56) References Cited

U.S. PATENT DOCUMENTS

2005/0028783 A1* 2/2005 Sun ..... F02M 57/023 123/299
2013/0139791 A1* 6/2013 Kusakabe ..... F02D 41/20 123/478
(Continued)

FOREIGN PATENT DOCUMENTS

EP 2 538 061 A2 12/2012
JP 2011-032922 A 2/2011
(Continued)

OTHER PUBLICATIONS

International Search Report dated May 10, 2016 as received in corresponding International Application No. PCT/JP2016/052853.
(Continued)

*Primary Examiner* — Xiao En Mo
(74) *Attorney, Agent, or Firm* — Foley & Lardner LLP

(57) ABSTRACT

The purpose of the present invention is to provide a drive device that improves the precision of injection quantities by stabilizing the behavior of a valve body 214 under the condition that a valve body reaches a height position lower than a maximum height position and making the injection pulse width and the injection quantity gradient small. The present invention is a drive device for a fuel injection device for use in an internal combustion engine, wherein: the fuel injection device is provided with a valve body 214 that can
(Continued)

open and close a fuel passage, a needle 202 that activates an opening and closing valve by transmitting power between itself and the valve body 214, and an electromagnet that comprises a solenoid 205 and a fixed core 207 provided as drive means for the needle 202, and a cylindrical nozzle holder 201 disposed on the outer peripheral side of the needle 202; and the drive device 150 controls a drive current flowing to the coil so as to decrease from the maximum drive current to a first drive current 610 that is lower than the maximum drive current before the valve body 214 reaches the maximum height position so that the valve body 214 reaches a height position lower than the maximum height position.

17 Claims, 13 Drawing Sheets

(51) Int. Cl.

| | |
|---|---|
| ***F02M 51/06*** | (2006.01) |
| ***F02M 51/00*** | (2006.01) |
| ***F02D 41/26*** | (2006.01) |
| ***F02D 41/30*** | (2006.01) |

(52) U.S. Cl.
CPC ..... *F02D 41/3064* (2013.01); *F02M 51/00* (2013.01); *F02M 51/06* (2013.01); *F02M 51/061* (2013.01); *F02M 61/10* (2013.01); *F02D 2041/2041* (2013.01); *F02D 2041/2051* (2013.01); *F02D 2041/2058* (2013.01)

(58) Field of Classification Search
CPC .... F02D 2041/2051; F02D 2041/2058; F02M 51/06; F02M 51/00; F02M 51/061; F02M 61/10
See application file for complete search history.

(56) References Cited

U.S. PATENT DOCUMENTS

| | | | |
|---|---|---|---|
| 2014/0311459 | A1 | 10/2014 | Katsurahara |
| 2016/0177855 | A1 | 6/2016 | Kusakabe et al. |
| 2017/0067430 | A1 | 3/2017 | Abe et al. |

FOREIGN PATENT DOCUMENTS

| | | | |
|---|---|---|---|
| JP | 2013-108422 | A | 6/2013 |
| JP | 2014-025419 | A | 2/2014 |
| WO | WO-2012/029507 | A1 | 3/2012 |
| WO | WO-2013/191267 | A1 | 12/2013 |
| WO | WO-2015/015541 | A1 | 2/2015 |

OTHER PUBLICATIONS

Written Opinion of the International Search Authority dated May 10, 2016 as received in corresponding International Application No. PCT/JP2016/052853.
Japanese Office Action issued in corresponding application No. 2017-502012 dated Apr. 3, 2018.
Extended European Search Report dated Sep. 26, 2018 in Application No. 16755144.9.

* cited by examiner

DRIVE DEVICE FOR FUEL INJECTION DEVICE

TECHNICAL FIELD

The present invention relates to a drive device which drives a fuel injection device of an internal combustion engine.

BACKGROUND ART

Generally, in order to promptly switch a valve closed state to a valve opened state, a drive circuit of an electromagnetic fuel injection device performs a control of applying a high voltage from a high voltage source to a coil in response to an output of an injection pulse to rapidly raise a current of the coil. Next, a control is performed in which a needle is separated from a valve seat to move toward a fixed core and the applied voltage is changed to a low voltage so that a constant current is supplied to the coil. When the supply of the current to the coil is stopped after the needle collides with the core, the valve opening operation of the needle is delayed and hence a controllable injection amount is limited. Thus, a control is required in which the supply of the current to the coil is stopped before the needle collides with the fixed core and a valve body is controlled in a so-called half-lift condition in which the needle and the valve body move according to a parabolic motion.

As a control method in the condition in which the valve body is driven in a half-lift state, a method disclosed in PTL 1 is particularly known. PTL 1 discloses a method of calculating an integrated value of a drive current flowing in a coil driving a fuel injection valve and calculating an inductance of the driving coil in consideration of a direct current superposition characteristic of the driving coil based on the integrated value. Accordingly, since the inductance is calculated with high accuracy, a lift amount can be highly accurately estimated by estimating the lift amount of the valve body based on the inductance.

CITATION LIST

Patent Literature

PTL 1: JP 2013-108422 A

SUMMARY OF INVENTION

Technical Problem

When the injection pulse is input, the drive device for the fuel injection device first applies the voltage of the high voltage source to the coil to quickly raise the current and rapidly generates a magnetic flux in the magnetic circuit. If a boost voltage VH is applied until the valve body reaches the fixed core, a magnetic attraction force acting on the needle increases and thus the gradient of the displacement amount of the valve body increases. As a result, in the half-lift condition which is an operation in which the valve body does not contact the fixed core, the gradients of the injection pulse width and the injection amount increase and the injection amount change amount increases with respect to a change in injection pulse width. Accordingly, there is a case in which the accuracy of the injection amount is degraded due to the limitation of the control resolution of the drive device. Further, when the magnetic attraction force acting on the needle is large, the needle collides with the fixed core in a condition in which the speed of the valve body is high. For this reason, the needle bounds due to a repelling force caused by the collision of the needle and thus the valve body also bounds. As a result, since a relation between the injection pulse and the injection amount is not linear in a range in which the valve body bounds, there is a case in which the control accuracy of the injection amount is degraded and the PN (Particulate Number) increases.

An object of the invention is to improve accuracy of an injection amount in a half-lift state by stabilizing a behavior of a valve body in the half-lift state and decreasing gradients of an injection pulse width and an injection amount and to ensure continuity of an injection amount in a range in which a needle in the half-lift state collides with a fixed core by reducing abound of the valve body caused by the collision of the needle with the fixed core.

Solution to Problem

In order to solve the above-described problems, a drive device of the invention controls a valve body so that the valve body reaches a height position lower than a maximum height position by decreasing a driving current flowing to a coil from a maximum current to a first drive current lower than the maximum current before the valve body reaches the maximum height position.

Advantageous Effects of Invention

According to the invention, it is possible to provide a drive device capable of reducing a controllable minimum injection amount by stabilizing a behavior of a valve body and decreasing gradients of an injection pulse width and an injection amount even when the valve body is controlled at a position lower than a maximum height position.

DESCRIPTION OF EMBODIMENTS

Hereinafter, embodiments of the invention will be described with reference to the drawings.

First Embodiment

Hereinafter, a fuel injection system including a fuel injection device and a drive device according to the invention will be described with reference to FIGS. 1 to 7.

Figure 1:
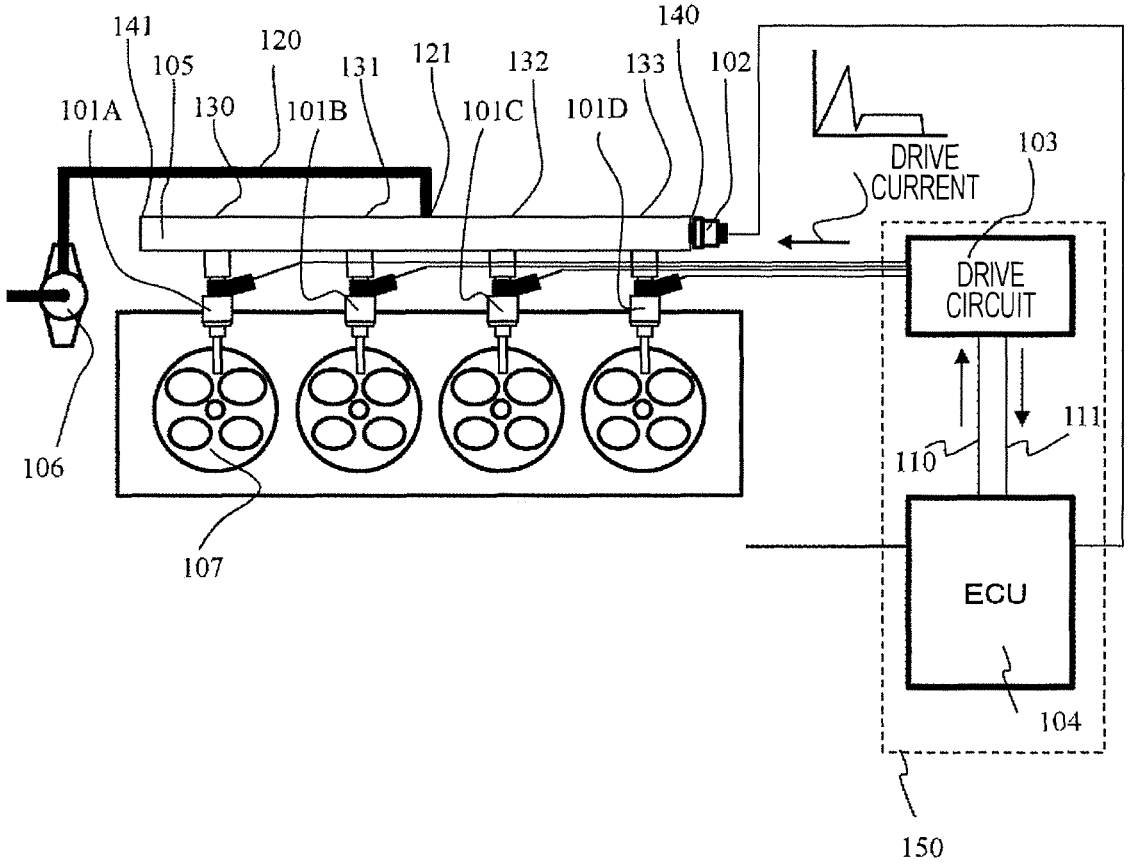
FIG. 1 is a schematic diagram showing a case where a fuel injection device, a pressure sensor, a drive device, and an ECU (Engine Control Unit) according to a first embodiment are mounted on an in-cylinder direct injection engine.

First, a configuration of the fuel injection system will be described with reference to FIG. 1. Fuel injection devices 101A to 101D are respectively installed in cylinders so that fuel is directly sprayed from injection holes to a combustion chamber 107. The fuel is pressurized by a fuel pump 106, is sent to a fuel pipe 105, and is delivered to the fuel injection devices 101A to 101D. An ejection amount from the fuel pump 106 is controlled so that a fuel pressure becomes a predetermined pressure as a target value based on information obtained by a pressure sensor 102.

The injection of the fuel from the fuel injection devices 101A to 101D is controlled by a width of an injection pulse sent from an engine control unit (ECU) 104. The injection pulse is input to a drive circuit 103 of the fuel injection device. Then, the drive circuit 103 determines a drive current waveform based on an instruction from the ECU 104 and supplies a drive current waveform to the fuel injection devices 101A to 101D based on the injection pulse. Additionally, the drive circuit 103 is mounted as a component or a substrate integrated with the ECU 104 and an integrated device thereof is referred to as a drive device 150.

Figure 2:
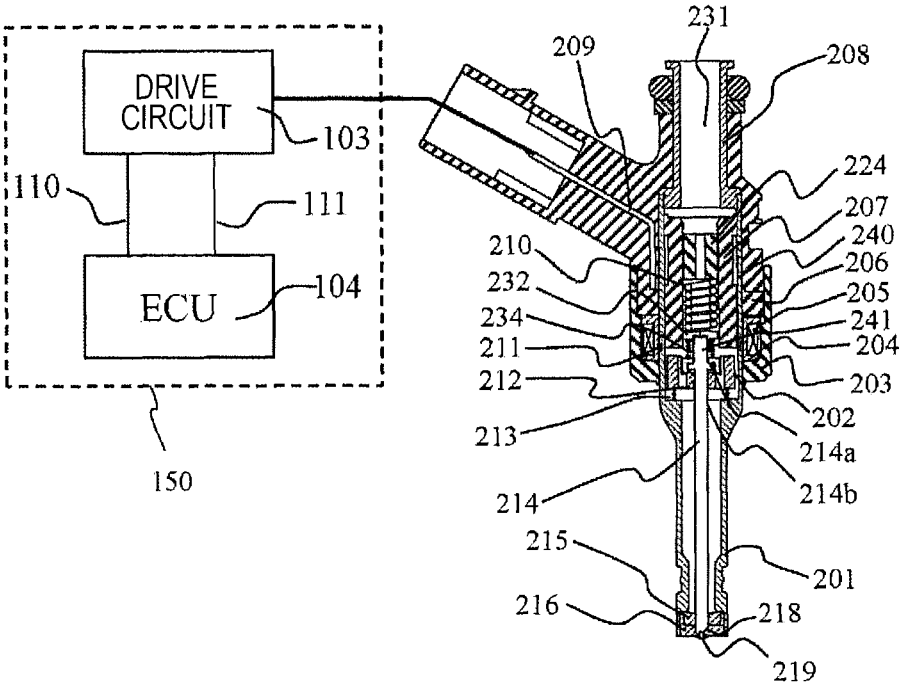
FIG. 2 is a longitudinal cross-sectional view of the fuel injection device according to the first embodiment of the invention and is a diagram showing a configuration of a drive circuit and an engine control unit (ECU) connected to the fuel injection device.

FIG. 2 is a longitudinal cross-sectional view of the fuel injection device and is a diagram showing an example of a configuration of the ECU 104 and the drive circuit 103 for driving the fuel injection device. Additionally, in FIG. 2, the same reference numerals will be given to the same components as those of FIG. 1 and the description thereof will be omitted. The ECU 104 receives a signal indicating an engine state from various sensors and calculates an injection pulse width or an injection timing for controlling an injection amount from the fuel injection device in response to an operation condition of an internal combustion engine. The injection pulse which is output from the ECU 104 is input to the drive circuit 103 of the fuel injection device via a signal line 110. The drive circuit 103 supplies a current by controlling a voltage applied to a solenoid 205. The ECU 109 communicates with the drive circuit 103 via a communication line 111 and can change a setting value of a driving time or a drive current generated by the drive circuit 103 based on an operation condition or a pressure of fuel supplied to the fuel injection device.

Figure 3:
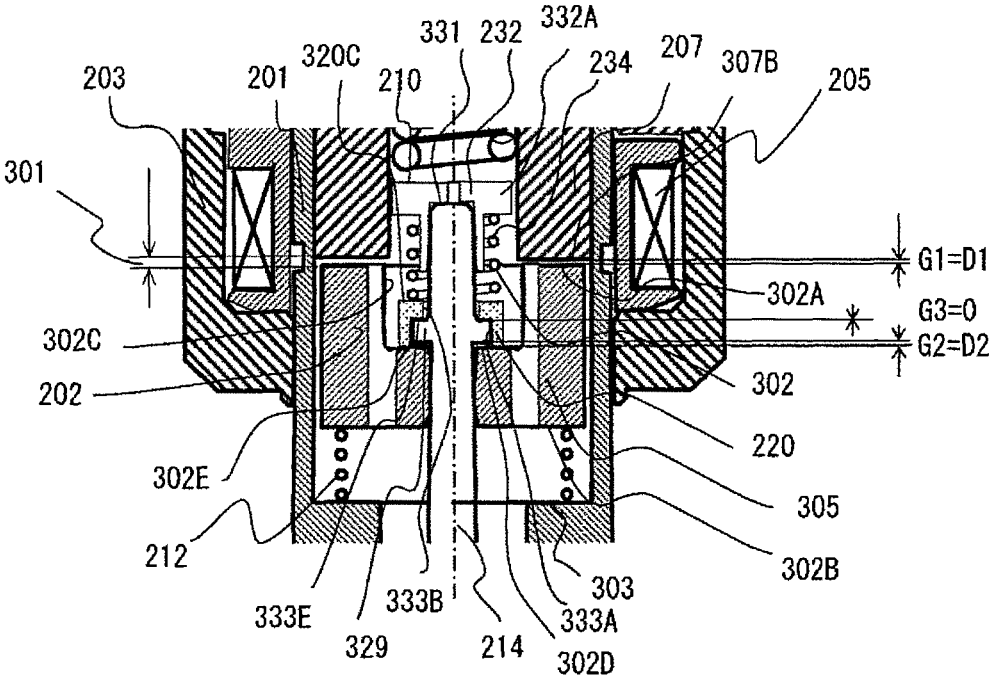
FIG. 3 is a diagram showing an enlarged cross-sectional view of a structure of a driving unit of the fuel injection device according to the first embodiment of the invention.

Next, a configuration and an operation of the fuel injection device will be described with reference to a longitudinal cross-sectional view of the fuel injection device of FIG. 2 and an enlarged cross-sectional view in the vicinity of a needle 202 and a valve body 214 of FIG. 3. The fuel injection device shown in FIGS. 2 and 3 is a normally closed electromagnetic fuel injection device. Here, in a state where a current is not supplied to the solenoid (the coil) 205, the valve body 214 is urged in the valve closing direction by a first spring 210 so that the valve body 214 contacts a valve seat 218 to close the valve.

An upper end surface 302A of the needle 202 is provided with a concave portion 302C which is formed to be directed toward the lower end surface 302B. A lower surface side of an intermediate member 220 provided inside the concave portion 302C is provided with a concave portion 333A which is directed upward. The concave portion 333A has a diameter (an inner diameter) and a depth in which a stepped portion 329 of a head portion 214A is received therein. That is, the diameter (the inner diameter) of the concave portion 333A is larger than the diameter (the outer diameter) of the stepped portion 329 and the depth dimension of the concave portion 333A is larger than the dimension between the upper end surface and the lower end surface of the stepped portion 329. The bottom portion of the concave portion 333A is provided with a penetration hole 333B in which a protrusion portion 131 of the head portion 214A penetrates. A third spring 234 is held between the intermediate member 220 and a cap 232 and an upper end surface 320C of the intermediate member 220 forms a spring seat which contacts one end portion of the third spring 234. The third spring 234 urges the needle 202 from a fixed core 207 in the valve closing direction.

The upper end portion of the cap 232 located above the intermediate member 220 is provided with a flange portion 332A which protrudes in the radial direction and a spring seat which contacts the other end portion of the third spring 234 is formed at the lower end surface of the flange portion 332A. A cylindrical portion 332C is formed downward from the lower end surface of the flange portion 332A of the cap 232 and the upper portion of the valve body 214 is fixed to the cylindrical portion 332C by press-inserting.

Since the cap 232 and the intermediate member 220 respectively form the spring seat of the third spring 234, the diameter (the inner diameter) of the penetration hole 333B of the intermediate member 220 is smaller than the diameter (the outer diameter) of the flange portion 332A of the cap 232.

The cap 232 receives an urging force of the first spring 210 from above and receives an urging force (a set load) of the third spring 234 from below. The urging force of the first spring 210 is larger than the urging force of the third spring 234, so that the cap 232 is pressed against the protrusion portion 331 of the valve body 214 by an urging force corresponding to a difference between the urging force of the first spring 210 and the urging force of the third spring 234. Since no force is applied to the cap 232 in a direction in which the cap is separated from the protrusion portion 331, the cap 232 can be sufficiently fixed to the protrusion portion 331 by press-inserting instead of welding.

The state shown in FIG. 2 is a state where the valve body 214 receives the urging force of the first spring 210 and a magnetic attraction force is not applied to the needle 202. In this state, the intermediate member 220 receives the urging force of the third spring 234 and a bottom surface 333E of the concave portion 333A contacts the upper end surface of the stepped portion 329 of the valve body 214. That is, the size (the dimension) of the gap G3 between the bottom surface 333E of the concave portion 333A and the upper end surface of the stepped portion 329 is zero.

Meanwhile, the needle 202 receives an urging force of a zero spring (a second spring) 212 to be urged toward the fixed core 207. For this reason, the needle 202 contacts the lower end surface of the intermediate member 220. Since the urging force of the second spring 212 is smaller than the urging force of the third spring 234, the needle 202 cannot press back the intermediate member 220 urged by the third spring 234 and the movement in the upward direction (the valve opening direction) is suppressed by the intermediate member 220 and the third spring 234.

Since the depth dimension of the concave portion 333A of the intermediate member 220 is larger than the dimension between the upper end surface and the lower end surface of the stepped portion 329, the needle 202 does not contact the lower end surface of the stepped portion of the valve body 214 and the gap G2 between the needle 202 and the lower end surface of the stepped portion of the valve body 214 has a size (a dimension) D2 in the state shown in FIG. 3. The gap G2 is smaller than the size (the dimension) D1 of the gap G1 between the upper end surface (a facing surface of the fixed core 107) 202A of the needle 202 and the lower end surface (a facing surface of the needle 202) 207B of the fixed core 107 (D2<D1). As described herein, the intermediate member 220 is a member that forms the gap G2 having a size D2 between the needle 202 and the lower end surface of the stepped portion 329.

When the lower end surface of the intermediate member (the gap forming member) 220 contacts the needle 202 while the intermediate member is positioned to the upper end surface (the reference position) of the stepped portion 329 of the valve body 214, the gap D2 is formed between the lower end surface of the stepped portion 329 of the engagement portion of the valve body 214 and the bottom surface 302D of the concave portion which is the engagement portion of the needle 202. The third spring 234 urges the intermediate member 233 in the valve closing direction so that the intermediate member contacts the upper end surface (the reference position) of the stepped portion 329. The intermediate member 233 is positioned to the upper end surface (the reference position) of the stepped portion 329 when the bottom surface 333E of the concave portion contacts the upper end surface (the reference position) of the stepped portion 329. Among the first spring 210, the second spring 212, and the third spring 234, the spring force (the urging force) of the first spring 210 is the largest, the spring force (the urging force) of the third spring 234 is secondly large, and the spring force (the urging force) of the second spring 212 is the smallest.

In the valve body 214, since the diameter of the penetration hole 128 formed in the needle 202 is smaller than the diameter of the stepped portion 329, the lower end surface of the stepped portion 329 of the valve body 214 engages with the needle 202 so that the needle 202 and the valve body 114 move together during a valve opening operation in which the valve closed state is switched to the valve opened state or a valve closing operation in which the valve opened state is switched to the valve closed state. However, when a force of moving the valve body 114 upward, that is, a force of moving the needle 202 downward is independently exerted, the valve body 114 and the needle 202 can be moved in different directions. The operations of the needle 202 and the valve body 214 will be described in detail later.

In the embodiment, the movement of the needle 202 in the vertical direction (the valve opening/closing direction) is guided in such a manner that the outer peripheral surface contacts the inner peripheral surface of the nozzle holder 201. Further, the movement of the valve body 214 in the vertical direction (the valve opening/closing direction) is guided in such a manner that the outer peripheral surface contacts the inner peripheral surface of the penetration hole of the needle 202. The front end portion of the valve body 214 is guided by the guide hole of the guide member 215 and is guided by the guide member 215, the nozzle holder 201, and the penetration hole of the needle 202 to move straightly in a reciprocating manner.

Additionally, in the embodiment, a case in which the upper end surface 302A of the needle 202 contacts the lower end surface 307B of the fixed core 207 has been described, but a case may be employed in which a protrusion portion is provided in any one of the upper end surface 302A of the needle 202 and the lower end surface 307B of the fixed core 207 or both the upper end surface 302A of the needle 202 and the lower end surface 307B of the fixed core 207 and the end surface of the protrusion portion contact any protrusion portion. In this case, the above-described gap G1 becomes a gap between a contact portion near the needle 202 and a contact portion near the fixed core 207.

In FIG. 2, the fixed core 207 is press-inserted into an inner peripheral portion of a large-diameter cylindrical portion 240 of the nozzle holder 201 and is welded at the press-inserting contact position. The fixed core 207 is a component which exhibits a magnetic attraction force in the needle 202 to attract the needle 202 in the valve opening direction. A gap formed between external air and the inside of the large-diameter cylindrical portion 23 of the nozzle holder 201 is sealed by the welding of the fixed core 207. A penetration hole having a diameter slightly larger than the diameter of the intermediate member 233 is provided as a fuel passage at the center of the fixed core 207. The cap 232 and the head portion of the valve body 214 are inserted through the inner periphery of the lower end portion of the penetration hole in a non-contact state.

The lower end of the spring 210 for setting an initial load contacts a spring receiving surface formed on the upper end surface of the cap 232 provided at a head portion 241 of the valve body 214 and the other end of the spring 210 is received by an adjustment pin 224 press-inserted into the penetration hole of the fixed core 207 so that the spring 210 is fixed between the cap 232 and the adjustment pin 224.

When the fixed position of the adjustment pin 224 is adjusted, an initial load in which the spring 210 presses the valve body 214 against the valve seat 218 can be adjusted.

In a state where the initial load of the spring 210 is adjusted, the lower end surface of the fixed core 207 faces the upper end surface of the needle 202 with the magnetic attraction gap G1 of about 40 to 100 micron formed therebetween. Further, in the drawings, the dimensions are displayed while the ratios are not taken into consideration.

The large-diameter cylindrical portion 240 of the nozzle holder 201 is inserted through a penetration hole formed at the center of a bottom portion of a housing 203. A portion of the outer peripheral wall of the housing 203 forms an outer peripheral yoke portion which faces the outer peripheral surface of the large-diameter cylindrical portion 240 in the nozzle holder 201. The coil 205 includes an annular bobbin 204 which includes a groove having a U-shaped cross-section and opened outward in the radial direction and a copper wire which is wound in the groove. A rigid conductor 209 is fixed to a winding start portion and a winding end portion of the coil 205. A magnetic passage is formed in an annular shape at a portion of the fixed core 207, the needle 202, the large-diameter cylindrical portion 240 of the nozzle holder 201, and the housing (the outer peripheral yoke portion) 203 to surround the coil 205.

The fuel is supplied from the fuel pipe installed at the upstream of the fuel injection device and flows to the front end of the valve body 214 through a first fuel passage hole 231. The fuel is sealed by the valve seat 218 and the seat portion formed at the end portion near the valve seat 218 in the valve body 214. When the valve is closed, a differential pressure is generated between the upper and lower portions of the valve body 214 by the fuel pressure and the valve body 214 is pressed in the valve closing direction by a force obtained by multiplying the fuel pressure by the pressure receiving area of the seat inner diameter at the valve seat position. In the valve closed state, the gap G2 is formed between the needle 202 and the contact surface of the valve body 214 with respect to the needle 202 through the intermediate member 220. Since the gap G2 is provided, the needle 202 is disposed to have a gap with respect to the valve body 214 in the axial direction while the valve body 214 sits on the valve seat 218.

When a current is supplied to the solenoid 205, a magnetic flux passes between the fixed core 207 and the needle 202 due to a magnetic field generated by a magnetic circuit and a magnetic attraction force is applied to the needle 202. At a timing in which the magnetic attraction force which acts on the needle 202 exceeds the load generated by the third spring 234, the needle 202 starts to be displaced in the direction of the fixed core 207. At this time, since the valve body 214 and the valve seat 218 contact each other, the movement of the needle 202 is performed in a state without the flow of the fuel and is an idling movement independently from the valve body 214 that receives the differential pressure by the fuel pressure. Accordingly, the needle can move at a high speed without the influence of the pressure of the fuel and the like.

Further, there is a need to strongly set the load of the first spring 214 in order to suppress the injection of the fuel even when a combustion pressure inside an engine cylinder increases. That is, since the load of the first spring 214 does not act on the valve body 214 in the valve closed state, the valve body 214 can move at a high speed.

When the displacement amount of the needle 202 reaches the size of the gap G2, the needle 202 transmits a force to the valve body 214 through a contact surface 302E so that the valve body 214 is pulled up in the valve opening direction. At this time, since the needle 202 moves idly and collies with the valve body 214 while having kinetic energy, the valve body 214 receives the kinetic energy of the needle 202 and starts to be displaced at a high speed in the valve opening direction. A differential pressure which is generated by the pressure of the fuel is applied to the valve body 214 and the differential pressure acting on the valve body 214 is generated by a decrease in pressure of the front end portion of the valve body 214 according a decrease in pressure generated by a decrease in static pressure caused by a Bernoulli effect after the flow rate of the fuel at the seat portion increases in a range having a small passage cross-sectional area in the vicinity of the seat portion of the valve body 214. Since the differential pressure is largely influenced by the passage cross-sectional area of the seat portion, the differential pressure increases in a condition in which the displacement amount of the valve body 214 is small and the differential pressure decreases in a condition in which the displacement amount is large.

Thus, since the valve body 214 is opened by a collision in accordance with the idle movement of the needle 202 at a timing in which the valve body 214 starts to open the valve from the valve closed state so that the displacement is small, the differential pressure increases, and the valve opening operation is difficult, the valve opening operation can be performed even in a state where a higher fuel pressure is exhibited. Alternatively, it is possible to set the first spring 210 to a stronger force in the fuel pressure range necessary for the operation. Since the first spring 210 is set to a stronger force, a time necessary for the valve closing operation to be described later can become short and thus a minute injection amount can be effectively controlled.

After the valve body 214 starts the valve opening operation, the needle 202 collides with the fixed core 207. At the time in which the needle 202 collides with the fixed core 207, the needle 202 bounds backward, but the needle 202 is attracted and stopped by the fixed core 207 due to the magnetic attraction force acting on the needle 202. At this time, since a force which is exerted in the direction of the fixed core 207 by the first spring 212 is applied to the needle 202, the rebounding displacement amount can be decreased and a time taken until the rebounding is stabilized can become short. Since the rebounding operation is small, a time in which a gap between the needle 202 and the fixed core 207 increases becomes short and thus a stable operation can be performed even in a smaller injection pulse width.

The needle 202 and the valve body 214 having used to perform the valve opening operation in this way are stopped in the valve opened state. In the valve opened state, a gap is formed between the valve body 214 and the valve seat 218 and the fuel is injected. The fuel flows in the downstream direction while passing through the center hole formed in the fixed core 207, the fuel passage hole formed in the needle 202, and the fuel passage hole formed in the guide member 215. When the supply of the current to the solenoid 205 is stopped, a magnetic flux generated in the magnetic circuit disappears and a magnetic attraction force also disappears. Since the magnetic attraction force acting on the needle 202 disappears, the valve body 214 is pressed back to a closed position in which the valve body contacts the valve seat 218 due to a force generated by the fuel pressure and the load of the first spring 210.

Figure 5:
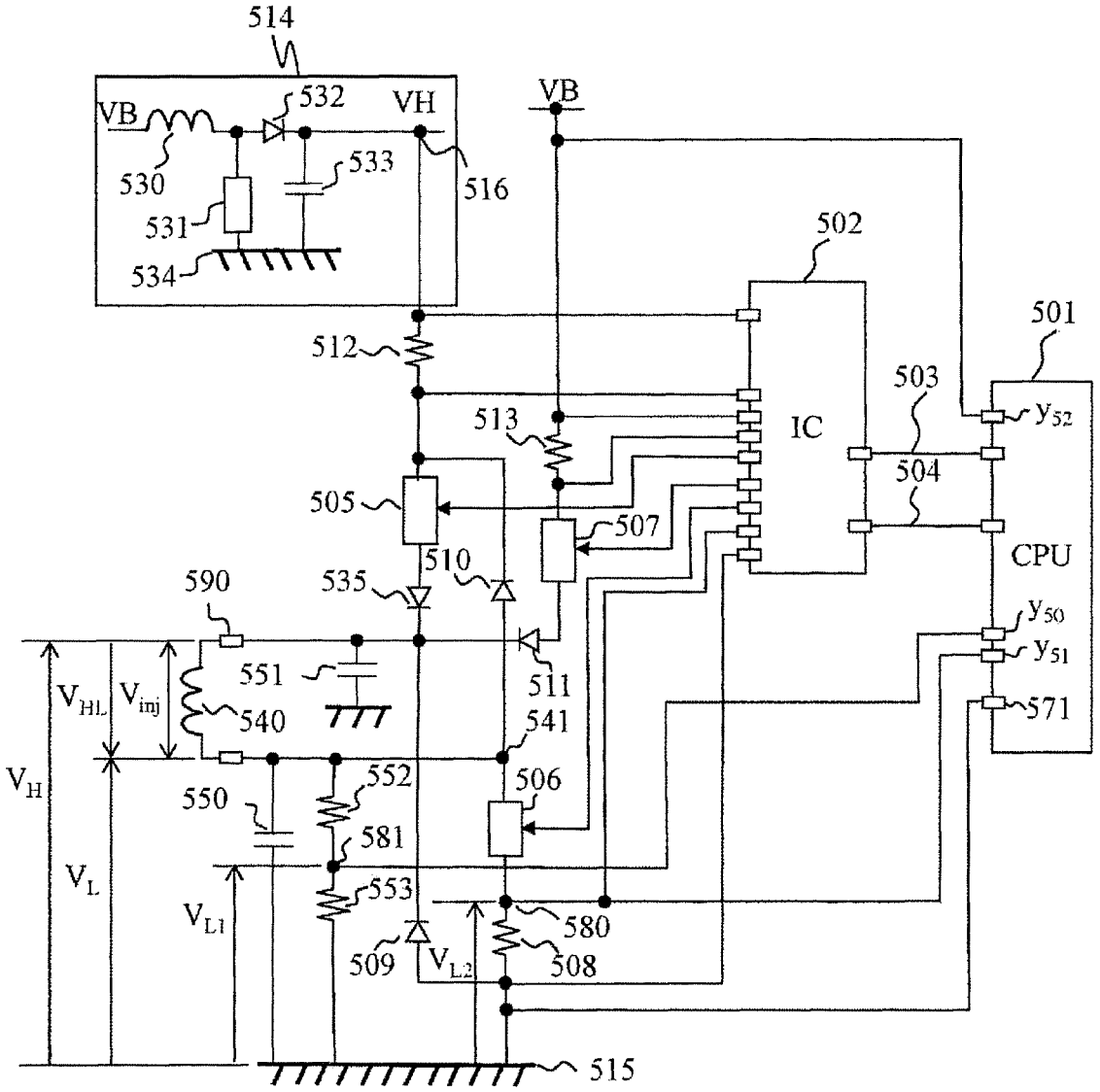
FIG. 5 is a diagram showing a detail of the ECU (Engine Control Unit) and the drive device of the fuel injection device according to the first embodiment of the invention.

Next, a configuration of the drive device of the fuel injection device according to the embodiment will be described with reference to FIG. 5. FIG. 5 is a diagram specifically showing the ECU 104 and the drive circuit 103 of the fuel injection device.

The CPU 501 is built in, for example, the ECU 104 and calculates an injection timing or an injection pulse width for controlling an injection amount from the fuel injection device in response to an operation condition of an internal combustion engine by receiving signals indicating an engine state from various sensors described above including a pressure sensor which is attached to an upstream fuel pipe of the fuel injection device, an A/F sensor which measures the amount of air flowing into an engine cylinder, an oxygen sensor which detects an oxygen concentration of an exhaust gas discharged from an engine cylinder, and a crank angle sensor. Further, the CPU 501 calculates an appropriate injection timing or an appropriate injection pulse width Ti (that is, an injection amount) in response to the operation condition of the internal combustion engine and outputs the injection pulse width Ti to a driving IC 502 of the fuel injection device via a communication line 504. Next, the supply of the current to switching elements 505, 506, and 507 is switched by the driving IC 502 so that a drive current is supplied to a fuel injection device 540.

A switching element 805 is connected between a high voltage source which is higher in voltage than a voltage source VB input to the drive circuit and a high voltage side terminal of the fuel injection device 540. The switching elements 505, 506, and 507 are configured as, for example, FETs or transistors and the supply of the current to the fuel injection device 540 can be switched. A boost voltage VH which is an initial voltage value of the high voltage source is, for example 60 V and is generated when a battery voltage is raised by a boost circuit 514. There is known a method in which the boost circuit 514 includes, for example, a DC/DC converter or the like or a coil 530, a transistor 531, a diode 532, and a capacitor 533. In the case of the latter boost circuit 514, when the transistor 531 is turned on, a battery voltage VB flows toward a ground potential 534, but when the transistor 531 is turned off, a high voltage generated in the coil 530 flows through the diode 532 so that electric charge is accumulated in the capacitor 533. The transistor is repeatedly turned on and off until the voltage becomes the boost voltage VH so that the voltage of the capacitor 533 increases. The transistor 531 is connected to the IC 502 or the CPU 501 and the boost voltage VH output from the boost circuit 519 is detected by the IC 502 or the CPU 501.

Further, a diode 535 is provided between a power supply side terminal 590 of the solenoid 205 and the switching element 505 so that a current flows from the second voltage source toward the solenoid 205 and the installation potential 515 and a diode 511 is also provided between the power supply side terminal 590 of the solenoid 205 and the switching element 507 so that a current flows from the battery voltage source toward the solenoid 205 and the installation potential 515. While the current flows in the switching element 508, the current cannot flow from the ground potential 515 toward the solenoid 205, the battery voltage source, and the second voltage source. Further, the ECU 104 is provided with a register and a memory which are used to memorize numerical data necessary for the control of the engine when calculating the injection pulse width or the like.

Further, the switching element 507 is connected between the low voltage source and the high voltage terminal of the fuel injection device. The low voltage source VB is, for example, a battery voltage and a voltage value is about 12 to 14 V. The switching element 506 is connected between the low voltage side terminal of the fuel injection device 540 and the ground potential 515. The driving IC 502 detects a value of a current flowing in the fuel injection device 540 by current detecting resistances 508, 512, and 513 and generates a desired drive current by switching the supply of the current to the switching elements 505, 506, and 507 based on the detected current value. The diodes 509 and 510 are provided to rapidly reduce the current supplied to the solenoid 205 by applying a reverse voltage to the solenoid 205 of the fuel injection device. The CPU 501 communicates with the driving IC 502 via a communication line 503 and can change a drive current generated by the driving IC 502 based on the operation condition or the pressure of the fuel supplied to the fuel injection device 540. Further, both ends of the resistances 508, 512, and 513 are connected to an A/D converter of the IC 502 and the voltage applied to both ends of the resistances 508, 512, and 513 is detected by the IC 502.

Next, a relation (FIG. 4) of the injection pulse output from the ECU 104, the drive voltage of both ends of the terminal of the solenoid 205 of the fuel injection device, the drive current (the excitation current), and the displacement amount (the behavior of the valve body) of the valve body 214 of the fuel injection device and a relation (FIG. 7) of the injection pulse and the fuel injection amount according to the embodiment will be described.

When an injection pulse is input to the drive circuit 103, the drive circuit 103 starts the supply of the current to the solenoid 205 by applying the high voltage 401 to the solenoid 205 from the high voltage source of which the voltage is raised to be higher than the battery voltage through the switching elements 505 and 506. When the current value reaches a maximum drive current $I_{peak}$ (hereinafter, referred to as a peak current value) set in the ECU 104 in advance, the application of the high voltage 401 is stopped.

When the switching element 506 is turned on during a period in which the peak current value $I_{peak}$ changes to the current 403 and the supply of the current to the switching elements 505 and 507 is interrupted, a voltage of 0 V is applied to the solenoid 205 and the current flows along the fuel injection device 540, the switching element 506, the resistance 508, the ground potential 515, and the fuel injection device 540 so that the current gently decreases. Since the current gently decreases, the current supplied to the solenoid 205 is ensured. Thus, the needle 202 and the valve body 214 can stably perform the valve opening operation even when the pressure of the fuel supplied to the fuel injection device 540 increases. In addition, when the switching elements 505, 506, and 507 are turned off during a period in which the peak current value $I_{peak}$ changes to the current 403, the current is supplied to the diode 509 and the diode 510 due to a counter electromotive force caused by the inductance of the fuel injection device 540. Accordingly, the current returns to the voltage source VH and the current supplied to the fuel injection device 540 rapidly decreases from the peak current value $I_{peak}$ as in the current 402. As a result, since a time taken until the current reaches the current 403 becomes short, it is possible to effectively shorten a time in which the magnetic attraction force becomes constant after a predetermined delay time elapses from a timing in which the current reaches the current 403. When the current value becomes smaller than a predetermined current value 404, the drive circuit 103 supplies a current to the switching element 506 and makes a switching period for a control of keeping the predetermined current 403 by applying the battery voltage VB according to the supply of the current to the switching element 507.

When the pressure of the fuel supplied to the fuel injection device 540 increases, a fluid pressure acting on the valve body 214 increases and thus a time in which the opening degree of the valve body 214 reaches a target opening degree becomes longer. As a result, there is a case in which a timing reaching the target opening degree is late compared to a timing reaching the peak current $I_{peak}$. When the drive current rapidly decreases, the magnetic attraction force acting on the needle 202 also rapidly decreases, the behavior of the valve body 214 becomes unstable. Thus, in some cases, the valve closing operation may start even in a current supply state. When a current is supplied to the switching element 506 while the peak current $I_{peak}$ changes to the current 403 so that the current gently decreases, a decrease in magnetic attraction force can be suppressed and safety of the valve body 214 can be ensured at the high fuel pressure. Accordingly, it is possible to suppress a change in injection amount.

The fuel injection device 540 is driven by such a supply current profile. Up to the peak current value $I_{peak}$ from the application of the high voltage 401, the needle 202 starts to be displaced at the timing $t_{41}$ and the valve body 214 starts to be displaced at the timing $t_{42}$. Next, the opening degrees of the needle 202 and the valve body 214 reach the maximum opening degree (the maximum height position). Additionally, in the embodiment, the displacement amount in which the needle 202 contacts the fixed core 107 is set as the maximum height position of the needle. However, the invention is not particularly limited to a case where the valve body 214 moves in the vertical direction while the fuel injection device is mounted on the engine. Thus, the maximum height position of the needle 202 may be referred to as the maximum displacement position of the needle 202.

At the timing $t_{43}$ in which the needle 202 reaches the maximum height position, the needle 202 collides with the fixed core 207 and the needle 202 bounds against the individual core 207. Since the valve body 214 is formed to be displaceable relative to the needle 202, the valve body 214 is separated from the needle 202 and the displacement of the valve body 214 overshoots beyond the maximum height position. Next, the needle 202 is stopped at a predetermined maximum height position due to the magnetic attraction force generated by the holding current 403 and the force of the second spring 212 in the valve opening direction and the valve body 214 sits on the needle 202 to be stopped at the maximum height position, thereby forming the valve opened state.

In the case of the fuel injection device including a movable valve in which the valve body 214 and the needle 202 are integrated with each other, the displacement amount of the valve body 214 does not become higher than the maximum height position and the valve body 214 and the needle 202 reaching the maximum height position have the same displacement amount.

Next, an injection amount characteristic Q701 obtained using a current waveform shown in FIG. 4 will be described with reference to FIG. 7. When the injection pulse width Ti is not obtained for a predetermined time, the valve body 214 is not opened and the fuel is not injected in a condition that a force applied in the valve opening direction and obtained as the resultant force of the magnetic attraction force acting on the needle 202 and the load of the second spring 214 does not exceed the force in the valve closing direction corresponding to the load of the third spring 234 or the needle 202 cannot contact the valve body 214 while the magnetic attraction force necessary for sliding in the gap G3 is not ensured even after the needle 202 starts to be displaced.

Further, in the condition of, for example, the line 701 in which the injection pulse width Ti is short, the needle 202 collides with the valve body 214 and the valve body 214 is separated from the valve seat 218 to be lifted. However, since the valve is closed before the valve body 214 reaches a target lift position, the injection amount is small from a straight region 730 in which the injection pulse width and the injection amount have a linear relation to an alternate dotted-chain line 720.

Further, in the pulse width of the point 702, the valve closing operation is started immediately after the valve body 214 reaches the maximum height position and the locus of the valve body 214 becomes parabolic. In this condition, since the kinetic energy of the valve body 214 in the valve opening direction is large and the magnetic attraction force acting on the needle 202 is large, the portion of the time necessary to close the valve is large and thus the injection amount is large in the one-dotted chain line 720. A region 840 in which the valve body 214 does not contact the fixed core 207 and the locus of the valve body 214 becomes parabolic will be referred to as a half-lift region and a region 841 in which the valve body 214 contacts the fixed piece 207 will be referred to as a full-lift region.

In the injection pulse width of the point 703, since the valve closing operation is performed at a timing in which the bounding amount of the valve body 214 caused by the collision of the needle 202 with the fixed core 207 becomes maximal, a repelling force generated when the needle 202 collides with the fixed core 207 acts on the needle 202. Accordingly, a valve closing delay time until the valve body 214 closes the valve after the injection pulse is turned off becomes small. As a result, the injection amount is small in the one-dotted chain line 720. A point 704 indicates a state where the valve closing operation starts at the timing $t_{24}$ immediately after the bound of the valve body converges. Then, in the injection pulse width Ti larger than that of the point 704, the fuel injection amount substantially linearly increases in response to an increase in injection pulse width Ti. In a region to the pulse width Ti indicated by the point 704 after the injection of the fuel starts, the valve body 214 does not reach the maximum height position or the bound of the valve body 214 is not stabilized even when the valve body 214 reaches the maximum height position. For this reason, the injection amount changes. In order to decrease the controllable minimum injection amount, there is a need to increase a region in which the fuel injection amount linearly increases in response to an increase in injection pulse width Ti or to suppress a change in injection amount in a non-linear region in which a relation between the injection amount and the injection pulse width Ti smaller than the injection pulse width Ti 704 is not linear.

Figure 4:
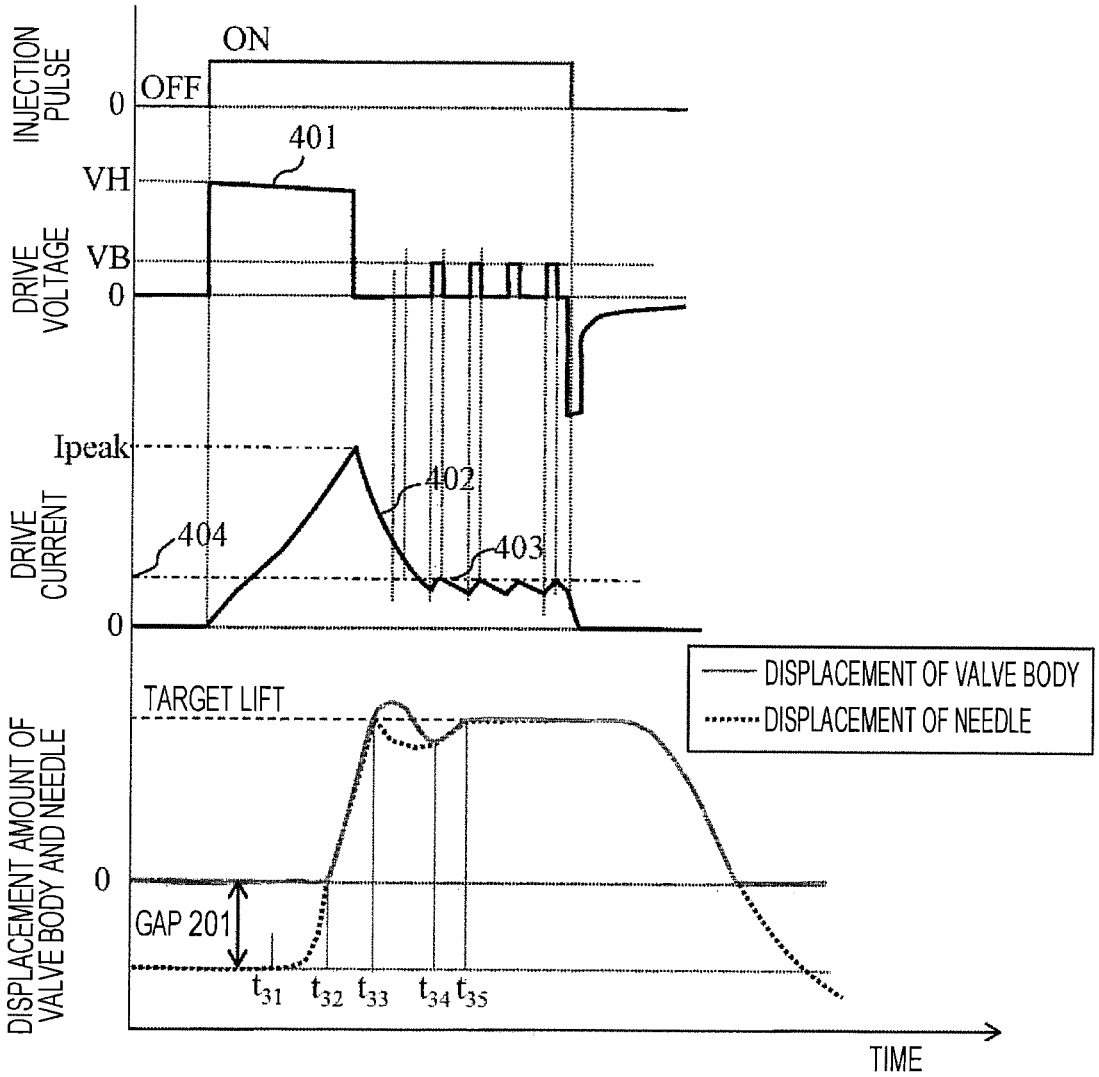
FIG. 4 is a diagram showing a relation of a general injection pulse for driving the fuel injection device, a drive voltage and a drive current supplied to the fuel injection device, and a valve body displacement amount in time.

In the drive current waveform described in FIG. 4, the bound of the valve body 214 generated by the collision between the needle 202 and the fixed core 207 is large and the valve closing operation starts while the valve body 214 bounds. For that reason, non-linearity is generated in a region of the injection pulse width Ti which is short to the point 704 and this non-linearity causes the minimum injection amount deterioration. Thus, there is a need to reduce the bound of the valve body 214 caused after the valve body reaches the maximum height position in order to solve the non-linearity of the injection amount characteristic in a condition in which the valve body 214 reaches the target lift. Further, since there is a change in behavior of the valve body 114 due to tolerance, a timing in which the needle 102 and the fixed core 107 contact each other becomes different for each fuel injection device. Further, since there is a change in collision speed between the needle 102 and the fixed core 107, the bound of the valve body 114 becomes different for each fuel injection device and each injection amount becomes uneven.

Meanwhile, since the valve body 214 behaviors unstably so as not to contact the fixed core 207 corresponding to a stopper in a region in which a driving (hereinafter, referred to as a half-lift) for allowing the valve body 214 to reach the height position lower than the maximum height position is performed, there is a need to accurately control the magnetic attraction force acting on the needle 202 for determining a speed when the needle 202 collides with the valve body 214 and the magnetic attraction force acting on the needle 202 after the valve body 214 starts to open the valve in order to accurately control the injection amount.

Figure 6:
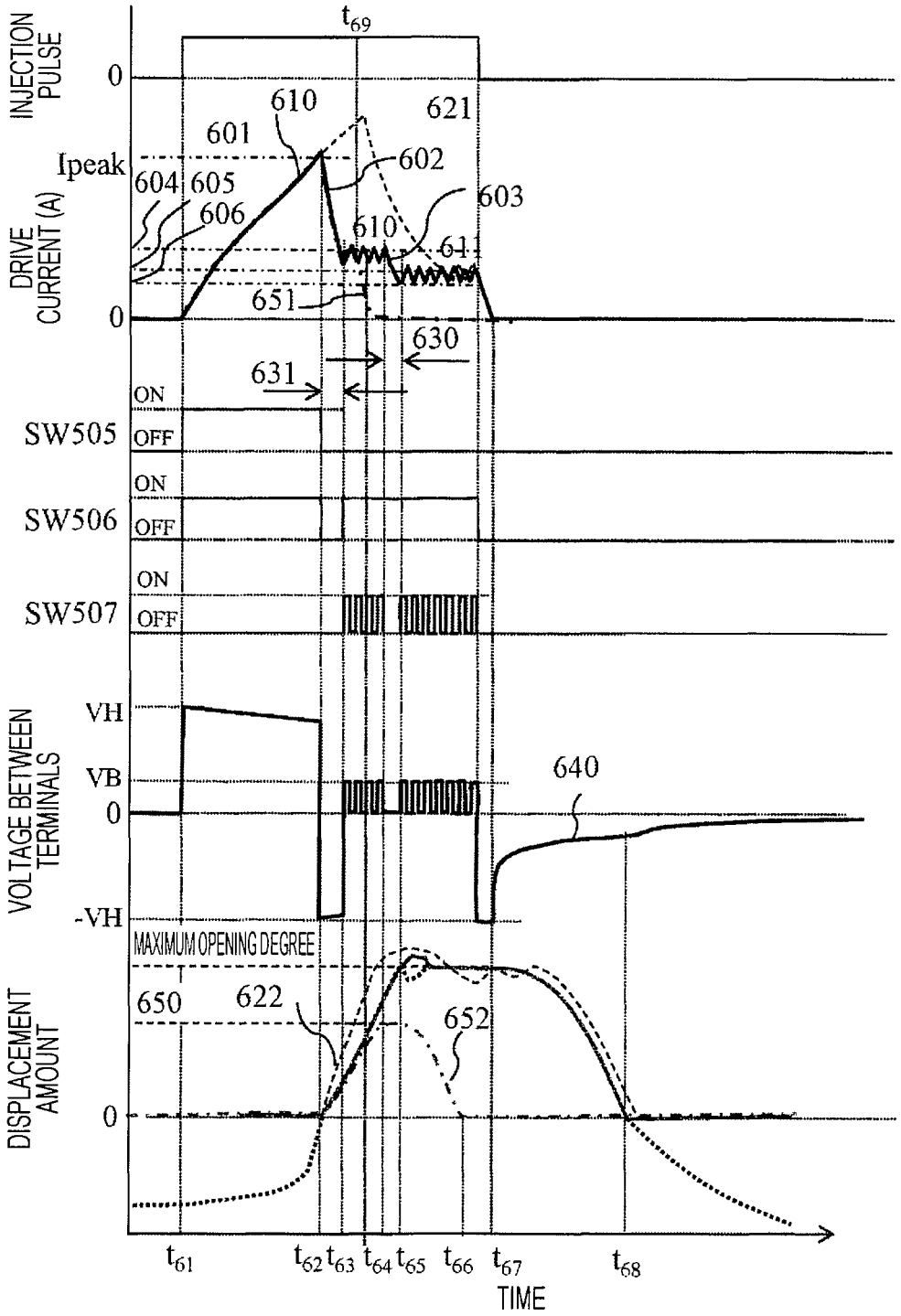
FIG. 6 is a diagram showing a relation of an injection pulse, a drive current supplied to the fuel injection device, a timing of a switching element of the fuel injection device, a voltage across coils, and a behavior of a valve body and a needle in time according to the first embodiment of the invention.

Next, the fuel injection device control method of the embodiment will be described with reference to FIGS. 6 and 7. FIG. 6 is a diagram showing a relation of an injection pulse, a drive current supplied to the fuel injection device, a voltage Vinj across terminals of the solenoid 205 and the switching elements 505, 506, and 507 of the fuel injection device, and a behavior of the valve body 214 and the needle 202 in time. Additionally, a displacement amount 722 of the valve body 214 and a drive current 721 when using the current waveform of FIG. 4 are indicated by a dashed line. FIG. 7 is a diagram showing a relation between the injection pulse width and the injection amount when the fuel injection device 540 is controlled in the drive current waveform of FIG. 6. Additionally, in FIG. 7, an injection amount characteristic when the fuel injection device 540 is controlled at a drive current 610 is indicated by an injection amount Q702.

First, when the injection pulse width Ti is input from the CPU 501 to the driving IC 502 via the communication line 504 at a timing $t_{61}$, the switching element 505 and the switching element 506 are turned on, the boost voltage VH higher than the battery voltage VH is applied to the solenoid 205, and the drive current is supplied to the fuel injection device 540 so that the current rapidly rises. When the current is supplied to the solenoid 205, the magnetic attraction force is exerted between the needle 202 and the fixed core 207. The needle 202 starts to be displaced at a timing in which a force in the valve opening direction corresponding to a resultant force of the magnetic attraction force and the load of the second spring 212 exceeds the load of the third spring 234 corresponding to the force in the valve closing direction. Next, after the needle 202 slides in the gap G2 so that the needle 202 collides with the valve body 214, the valve body 214 starts to be displaced so that the fuel is injected from the fuel injection device 540.

When the current reaches the peak current value $I_{peak}$, the supply of the current to the switching element 505, the switching element 506, and the switching element 507 is stopped, the current is supplied to the diode 509 and the diode 510 due to the counter electromotive force caused by the inductance of the fuel injection device 540, the current returns to the voltage source VH, and the current supplied to the fuel injection device 540 rapidly decreases from the peak current value $I_{peak}$ as in the current 602. Additionally, when the switching element 506 is turned on during a period in which the peak current value $I_{peak}$ changes to the first drive current 610, the current generated by the counter electromotive energy flows to the ground potential and the current gently decreases.

Next, when the time reaches a timing $t_{63}$, the supply of the current to the switching element 506 is resumed and the supply of the current to the switching element 507 is switched so that the current value of the first drive current 610 is held at the current value 604 or the vicinity thereof. Additionally, a period of controlling the first drive current 610 will be referred to as a first current hold period.

Further, the supply of the current to the switching element 505 and the switching element 507 is stopped and the current is supplied to the switching element 506 at a timing $t_{64}$ immediately after or before the displacement amount of the valve body 214 reaches the maximum height position after the first drive current 610 is held for a predetermined time so that the current gently decreases as in a current 603. Then, the supply of the current to the switching element 507 is switched again at a timing $t_{65}$ in which the current reaches a current 605 having a current value smaller than that of the first drive current 610 so that the current value of the second drive current 611 is held at the current value 605 or the vicinity thereof. Additionally, a period of controlling the second drive current 611 will be referred to as a second current hold period.

Next, a relation between a current waveform 651 and the valve body 214 in a half-lift condition in which the valve body 214 is driven at a height position 650 lower than the maximum height position will be described. Additionally, the displacement of the valve body 214 when using the current waveform 651 is indicated by a one-dotted chain line (displacement 652).

When the injection pulse Ti is stopped at a timing $t_{69}$ of the first drive current 610 after the valve body 214 starts to open the valve, the boost voltage VH is applied to the solenoid 205 in a negative direction so that the current decreases and reaches 0 A. When the supply of the current is stopped, the magnetic attraction force acting on the needle 202 decreases. Then, at a timing in which the force in the valve opening direction corresponding to the resultant force of the magnetic attraction force, the load of the second spring 212, and the inertia force of the needle 202 is lower than the force in the valve closing direction of the differential pressure acting on the first spring 210 and the valve body 214, the valve body 214 starts to close the valve from the height position 650 lower than the maximum height position. Then, at the timing $t_{67}$, the valve body contacts the valve seat 218 to stop the injection of the fuel.

In the current waveform 610 of the embodiment, the needle 202 slides in the valve opening direction to ensure the kinetic energy necessary for the valve opening operation so that the peak current $I_{peek}$ is stopped at an early timing. Accordingly, it is possible to decrease the gradient of the displacement amount of the valve 214 until the valve body reaches the maximum height position from the start of the valve opening operation of the valve body 214. That is, the CPU 501 of the ECU 104 of the embodiment controls the height position of the valve body 214 in the height position region (half-lift region) lower than the maximum height position by decreasing the drive current flowing to the solenoid 205 from the current $I_{peak}$ to the first drive current 610 lower than the current $I_{peak}$ before the valve body 214 reaches the maximum height position and changing the application time of the first drive current 610. That is, a control is performed so that the height position of the valve body 214 in the half-lift region increases as the application time of the first drive current 610 increases.

Alternatively, the CPU 501 controls the needle 202 so that the needle reaches the height position lower than the facing surface of the fixed piece 107 by decreasing the drive current flowing to the solenoid 205 from the maximum drive current $I_{peak}$ to the first drive current 610 before the needle 202 collides with the fixed piece 107. Then, the height position of the needle 202 at the height position region lower than the facing surface of the fixed piece 107 may be controlled in such a manner that the application time of the first drive current 610 changes. Further, the CPU 501 controls the needle 202 so that the needle collides with the fixed piece 107 by decreasing the current to the second drive current 611 lower than the first drive current 610. In addition, a time in which the needle 202 contacts the fixed piece 107 is controlled in such a manner that the application time of the second drive current 611 changes. Further, a control is performed so that the needle 202 reaches the height position lower than the facing surface of the fixed piece 611 in such a manner that the current is decreased to the first drive current 610 and is interrupted.

In other words, when the fuel is injected in the first injection amount region, the CPU 501 of the embodiment controls the needle 202 so that the needle reaches the height position lower than the facing surface of the fixed piece 611 by decreasing the drive current flowing to the solenoid 205 from the maximum drive current $I_{peak}$ to the first drive current 610 before the needle 202 collides with the fixed piece 611.

As a result, it is possible to decrease the gradients of the injection pulse Ti of the half-lift region 742 and the valve opening period of the valve body 214. This corresponds to a case where the changed injection amount decreases in accordance with a change in injection pulse Ti. Since there is a limitation in the resolution of the injection pulse width controlled by the ECU 104, it is possible to increase the control resolution of the injection amount and to improve the accuracy of the injection amount by decreasing the changed injection amount when the injection pulse width Ti changes. Since the accuracy of the injection amount is improved, the PN suppression effect is improved and the fuel can be appropriately injected in response to the engine rotation speed. As a result, it is possible to obtain an effect of improving drivability.

In the case of the fuel injection device 540 having a mechanism in which the needle 202 slides and collides with the valve body 214 to open the valve, the timing of interrupting the peak current $I_{peak}$ may be set to a timing before the valve body 214 starts to open the valve in a condition in which the needle 202 is accelerated to ensure the kinetic energy sufficient for the valve opening operation. As a result, it is possible to shorten the timing which changes to the first hold current period and to easily control the injection amount smaller than that of the half-lift region 742. A detailed description of the effect will made below.

Further, when the timing for stopping the peak current $I_{peak}$ is set to a timing immediately after the valve body 214 starts to open the valve, the energy (the integrated value of the current waveform) supplied to the solenoid 205 until the valve body 214 starts to open the valve is large and thus the kinetic energy at the time when the needle 202 collides with the valve body 214 can be easily ensured. As a result, even when the fuel pressure supplied to the fuel injection device 540 is large, the valve body 214 can be controlled stably to the valve opened state.

Further, in a cold start condition or a high-rotation/high-load condition in which knocking is likely to occur due to self ignition due to the high temperature and the high pressure of the unburned gas during the propagation of the flame in the engine cylinder, the necessity of the multi-stage injection is high and the smaller injection amount is required. Thus, in the above-described operation condition, a control of selecting the current waveform 621 may be performed by the ECU 104 in a condition in which the injection amount of the half-lift region 742 is not obtained by using the current waveform 610 of the first embodiment. When the fuel pressure supplied to the fuel injection device 540 increases, the displacement amount of the needle 202 does not change until the needle 202 collides with the valve body 214. However, since the differential pressure acting on the valve body 214 increases, the gradient of the displacement amount of the valve body 214 decreases even when the needle 202 collides with the valve body 214 at the same speed.

Thus, since the magnetic attraction force necessary for the valve opening operation increases, the current waveform selection control may be performed so that the peak current value $I_{peak}$ increases, the current value 610 of the first hold current period increases, or both values are corrected in response to an increase in fuel pressure. Due to this selection control, it is possible to suppress a change in locus of the displacement of the valve body 214 until the valve body reaches the maximum height position even when the fuel pressure changes and thus stably control the displacement amount of the valve body 214. As a result, since the accuracy of the injection amount can be improved, the PN suppression effect is improved. Further, when the number of fuel injections in the half-lift region 742 is large in the engine condition requiring the multi-stage injection, the PN suppression effect is easily obtained by the improvement in accuracy of the injection amount. By this effect, it is possible to decrease the gradients of the injection pulse and the injection amount in the half-lift region 742. Since the sensitivity of the injection amount with respect to a change in injection pulse width is set to be small, it is possible to highly accurately control the injection amount even when the control resolution of the injection pulse generated by the ECU 104 is large. Since the gradient of the injection amount is set to be small, the half-lift region 740 in the case of using the conventional current waveform 621 becomes the half-lift region 742.

As described above, since the differential pressure acting on the valve body 214 is largely influenced by the passage cross-sectional area of the seat portion, the differential pressure increases in a condition in which the displacement amount of the valve body 214 is small and the differential pressure decreases in a condition in which the displacement amount is large. Thus, since the valve of the valve body 214 is opened by a collision in accordance with the idle movement of the needle 202 at a timing in which the valve body 214 starts to open the valve from the valve closed state so that the displacement is small, the differential pressure is large, and the valve opening operation is difficult, the valve opening operation can be performed even in a state where the high fuel pressure is exhibited.

In the current waveform 621, an undulation generated in the injection amount characteristic after the half-lift region 740 changes to the full-lift region 741 is generated when the needle 202 collides with the fixed core 207. Thus, the current value may be decreased as in the current 603 in such a manner that the first hold current period is stopped before the valve body 214 reaches the maximum height position. Since the current value decreases, the speed of the needle 202 can be reduced or the acceleration thereof can be suppressed. Accordingly, it is possible to reduce the collision speed of the needle 202 at a timing in which the needle 202 collides with the fixed core 207. Further, it is possible to reduce the bound of the valve body 214 in accordance with the suppression of the bound of the needle 202. As a result, since it is possible to suppress an undulation generated in the injection amount characteristic after the half-lift region 742 changes to the full-lift region 743, it is possible to accurately control the injection amount.

When the injection pulse Ti is changed during the second current hold period in which the current becomes the second drive current 611, it is possible to change a time in which the valve body 214 is located at the maximum height position. That is, when the fuel is injected in the second injection amount region in which the injection amount is larger than that of the first injection amount region, the CPU 501 of the embodiment controls the needle 202 so that the needle collides with the fixed piece 107 by decreasing the drive current flowing to the solenoid from the maximum drive current $I_{peak}$ to the first drive current 610 before the needle 202 collides with the fixed piece 107 and then decreasing the second drive current 611. When the injection pulse Ti is set to be long, a time in which the valve body is located at the maximum height position becomes long and a time (referred to as a valve closing delay time) in which the valve body 214 contacts the valve seat 218 after the stop of the injection pulse Ti changes. A range causing the bound of the valve body 214 is excluded from the full-lift region and the injection amount is determined in synchronization with the valve closing delay time. When the valve closing delay time increases, the injection amount increases. Thus, since a time in which the valve body 214 is located at the maximum height position is controlled when the application time of the second drive current 611 is changed, the injection amount can be accurately controlled. As a result, the PN suppression effect can be improved.

Further, the current value 610 of the first current hold period may be set to be larger than the current value 611 of the second current hold period. In the valve opened state in which the valve body 214 performs the valve opening operation and is located at the maximum height position, it is easy to ensure the magnetic attraction force since a gap (a magnetic gap) between the needle 202 and the fixed core 207 is smaller than the valve closed state in which the valve body 214 contacts the valve seat 218 and the differential pressure acting on the valve body 214 is also small since the cross-sectional area of the seat portion of the valve body 214 is large. Thus, a current which is equal to or larger than the minimum current value 606 capable of keeping the valve body 214 in the valve opened state may be supplied to the solenoid 205. Meanwhile, the needle 202 and the valve body 214 are displaced during the first current hold period 610.

Thus, the magnetic attraction force is not easily ensured since the gap (the magnetic gap) between the needle 202 and the fixed core 207 is larger than that of the valve opened state and the differential pressure acting on the valve body 214 also increases since the cross-sectional area of the seat portion of the valve body 214 is small. Thus, since the magnetic attraction force necessary to open the valve is larger than that of the valve opened state, there is a need to set the current value 610 of the first current hold period to be larger than the current value 611 of the second current hold period in order to ensure the safety of the valve body 214 in the half-lift region. In the half-lift region, since the displacement amount of the valve body 214 in the half-lift region 742 and the valve open period until the valve closing operation ends from the start of the valve opening operation of the valve body 214 can be accurately determined by the kinetic energy generated by the collision of the needle 202 with the valve body 214 and the magnetic attraction force generated by the current value 610 during the first hold current period, a minute injection amount can be accurately controlled.

When the current is rapidly decreased from the peak current value $I_{peak}$ as in the current 602 by applying the boost voltage VH to the solenoid 205 in the negative direction in a case where the peak current value $I_{peak}$ changes to the current value 610 of the first hold current period, the current can reach the value of the first hold current period in a condition that the displacement amount of the valve body 214 is small in such a manner that the first hold current period is promptly selected while ensuring the kinetic energy after increasing the magnetic attraction force necessary to open the valve until a timing immediately before the start of the valve opening operation, that is, a timing in which the needle 202 collides with the valve body 214. Accordingly, a range in which the displacement amount of the valve body 214 is controlled at the first drive current 610 can be expanded in a direction having a small displacement amount. As a result, since the range of the injection amount which can be controlled during the first hold current period in the half-lift region 742 can be expanded in a direction having a small displacement amount, there is an effect that a control up to a minute injection amount can be performed.

Additionally, when the current is supplied to the switching element 506 during a period in which the peak current value $I_{peak}$ changes to the first drive current 610 and the switching elements 505 and 507 are turned off, a voltage of about 0 V is applied to the solenoid 205 so that the current decreases gently. In this case, since the current value supplied to the solenoid 205 increases, the magnetic attraction force increases at a timing in which the displacement amount of the valve body 214 is small. Accordingly, there is an effect that the valve body 214 can stably perform the valve opening operation. Particularly when the fuel pressure supplied to the fuel injection device 540 is large, the differential pressure acting on the valve body 214 increases. For this reason, a current waveform of applying a voltage of 0 V to the solenoid 205 may be used. Further, since the current promptly decreases even when the application voltage to the solenoid 205 is 0 V when the inductance of the fuel injection device 540 is small, the current may be controlled by using the application of the voltage of 0 V.

The application voltage obtained when the peak current value $I_{peak}$ changes to the first drive current 610 may be changed in response to the specification of the fuel injection device 540 or the fuel pressure supplied to the fuel injection device 540.

Further, when the first hold current period changes to the second hold current period, a voltage of 0 V or less may be applied to the solenoid 205 to rapidly decrease the current value. When the supply of the current to the switching elements 505, 506, and 507 is not allowed so that the boost voltage VH is applied to the solenoid 205 in the negative direction, a speed at which the current 603 decreases can be increased. Since an effect of decreasing the speed of the needle 202 is improved, it is possible to reduce the undulation of the injection amount characteristic caused by the bound of the valve body 214 and to improve the injection amount injection accuracy.

When the injection pulse Ti is stopped during a transition period 630 from the first current hold period to the second current hold period, the current waveform supplied to the solenoid 205 does not change even when the injection pulse Ti changes. Thus, a dead zone in which the injection amount does not change may be generated even when the injection pulse Ti changes. In this case, the injection amount is the same in a condition that the injection pulse is stopped at a timing in which the transition period 630 starts, that is, the first current hold period ends and a condition that the injection pulse is stopped at a timing in which the transition period 630 ends, that is, the second current hold period starts. Thus, when the injection amount larger than the injection amount at a timing in which the first current hold period ends is injected, the injection amount can be continuously controlled in such a manner that the injection pulse width is set while skipping the dead zone.

Further, when the supply of the current to the switching elements 505 and 507 is stopped and the current is supplied to the switching element 506 so that a voltage of about 0 V is applied to the solenoid 205, the boost voltage VH is applied to the solenoid 205 in the negative direction after the injection pulse Ti is stopped even when the injection pulse Ti is stopped during the transition period 630. Thus, it is possible to control the width of the current waveform application time of even when the application of the injection pulse Ti to the transition period 630 is stopped and to reduce the dead zone in which the injection amount does not change even when the injection pulse Ti changes. Accordingly, it is possible to ensure the continuity of the injection amount. As a result, since the injection amount can be appropriately changed in response to the rotation speed of the operation condition, drivability is improved.

Further, since the fuel adhering to wall surfaces of a piston and a cylinder hardly evaporates while the engine is cooled, there is a tendency that unburned particles increase in a cold start condition. As means for suppressing the generation of unburned particles in a cold start condition, it is effective to adopt a method of simultaneously achieving a low-startup exhaust and an early catalyst activation due to the adhesion of the fuel to the piston or cylinder wall by dividing the fuel injection until a fast idle state in which the engine rotation speed is constant at the cold start of the engine. In this case, when the undulation of the injection amount characteristic occurs after the half-lift region 740 changes to the full-lift region 741 as in the conventional current waveform 621, the injection amount cannot be continuously controlled and a range in which the fuel cannot be injected is generated. When it is desired to inject the fuel at a flow rate in which the undulation of the injection amount is generated, a method of injecting the fuel by changing the number of split injections of the fuel during one intake/exhaust stroke is also considered. However, when the number of split injections of the fuel increases during the cold start-up, an error occurs between the actual fuel injection amount and the target injection amount calculated by the ECU 104 at a timing of changing the number of split injections and thus a combustion becomes unstable.

Accordingly, there is a tendency that PN increases.

When the current waveform 610 of the first embodiment of the invention is used, it is possible to ensure the continuity of the injection amount until the half-lift region 742 changes to the full-lift region 743 and to suppress a change in the number of split injection in a condition that the accuracy of the injection amount is required. Thus, it is possible to improve the stability of the combustion and to suppress the PN.

Further, when the interruption timing of the peak current $I_{peak}$ is set to be earlier than the start of the valve opening operation of the valve body 214, it is possible to control a collision speed at which the needle 202 collides with the valve body 214 and to control the kinetic energy given from the needle 202 to the valve body 214. As a result, it is possible to control the gradient of the valve displacement amount after the valve body 214 starts to open the valve by changing a timing $t_{62}$ in which the peak current $I_{peak}$ is interrupted. Specifically, when the timing $t_{62}$ of interrupting the peak current $I_{peak}$ is set to be earlier, a speed at which the needle 202 collides with the valve body 214 decreases and the kinetic energy given to the valve body 214 decreases. For this reason, the gradient of the valve displacement amount decreases and the gradient of the injection amount characteristic in the half-lift region decreases. As a result, since the injection amount can be accurately controlled, the PN suppression effect is improved.

Further, since the differential pressure acting on the valve body 214 increases when the fuel pressure supplied to the fuel injection device 540 is large, the gradient of the displacement amount of the valve body 214 decreases after the valve body 214 starts to open the valve. Thus, the magnetic attraction force necessary until the valve body 214 reaches the maximum height position increases when the fuel pressure increases and the magnetic attraction force necessary until the valve body 214 reaches the maximum height position decreases when the fuel pressure decreases. Thus, the first drive current 610 may be determined in response to the fuel pressure.

When the fuel pressure increases to a set value or more, the first drive current 610 or the application time is increased to ensure the magnetic attraction force necessary for the valve opening operation and to improve the stability of the behavior of the valve body 214. As a result, since it is possible to accurately control the maximum height position and the valve open period in which the valve body 214 opens the valve, it is possible to improve the accuracy of the injection amount. When the fuel pressure decreases to a set value or less, the first drive current 610 or the application time is decreased to improve the accuracy of the injection amount.

Accordingly, even when the fuel pressure changes in the half-lift region, it is possible to suppress a change in gradient of the valve body displacement amount until the valve body 214 reaches the height position lower than the maximum height position from the start of the valve opening operation and to improve a behavior of the stability of the valve body 214.

Since the differential pressure acting on the valve body 214 increases when the fuel pressure increases, the valve closing delay time until the valve body 214 closes the valve after the stop of the injection pulse Ti is shortened. Since the differential pressure is influenced after the valve body 214 starts to open the valve, the behavior of the valve body 214 is largely influenced after the valve body reaches the height position 650 lower than the maximum height position. When the fuel pressure increases, the first drive current 610 is increased to increase the valve closing delay time. Accordingly, it is possible to remove an influence on the valve body 214 due to an increase in differential pressure in accordance with an increase in fuel pressure. As a result, since it is possible to suppress a change in height position 650 lower than the maximum height position and a change in valve open time of the valve body 214 in accordance with an increase in fuel pressure, it is possible to perform a stable operation with respect to a change in fuel pressure.

Figure 7:
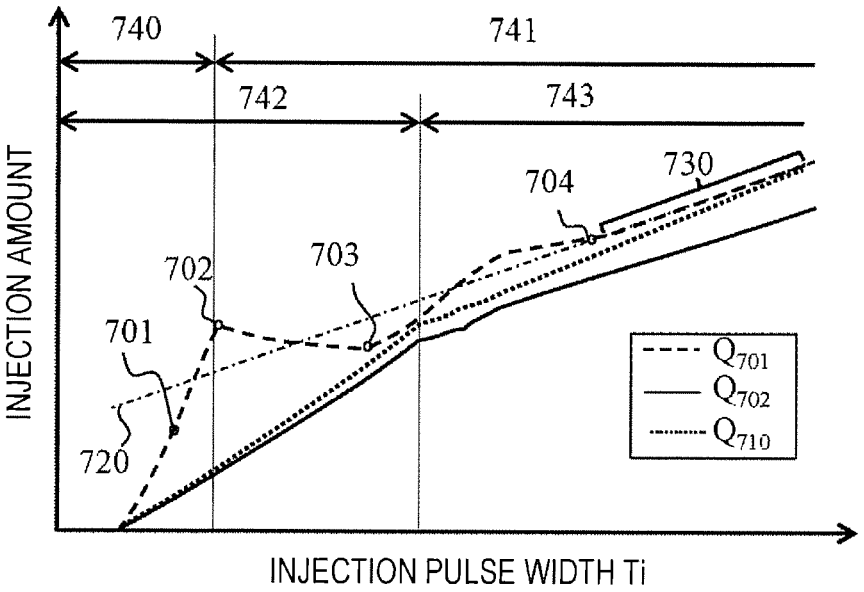
FIG. 7 is a diagram showing a relation of an injection pulse and an injection amount according to the first embodiment.

Q710 of FIG. 7 indicates the injection amount characteristic when the first drive current is corrected in a condition that the fuel pressure increases. Even when the valve open period of the valve body 214 and the height position 650 lower than the maximum height position are the same, the flow rate of the fuel flowing in an injection hole 219 increases when the fuel pressure changes and thus the injection amount also increases. Generally, in a hole like the injection hole 219, the injection amount is proportional to √ of the fuel pressure. When a change in valve open period of the valve body 214 is suppressed in a case where the fuel pressure increases, it is possible to accurately calculate a change in injection amount by the ECU 104 and to improve the accuracy of the injection amount. As a result, since it is possible to control the minute injection amount, it is possible to suppress the PN by increasing the number of multi-stage injections.

Further, since the differential pressure acting on the valve body 214 increases when the fuel pressure increases, the magnetic attraction force necessary for keeping the valve body 214 in the valve opened state changes. Thus, the second drive current 611 may be determined in response to the fuel pressure. Specifically, when the fuel pressure increases, the second drive current 611 may be increased to increase the magnetic attraction force.

Further, since the differential pressure acting on the valve body 214 increases, the valve closing delay time is shortened. Since the second drive current 611 is increased to increase the valve closing delay time, it is possible to obtain an effect of suppressing a decrease in valve closing delay time in accordance with an increase in differential pressure. As a result, since it is possible to suppress a change in valve open period and a change in valve closing delay time of the valve body 214 in accordance with an increase in fuel pressure and to suppress a change in injection amount, it is possible to improve the PN suppression effect. Additionally, since it is possible to improve the accuracy of the flow rate in the half-lift region and the full-lift region by the corrections of the first drive current and the second drive current, it is possible to obtain an effect of improving the accuracy of the injection amount in a target region by a single correction thereof.

Further, the differential pressure acting on the valve body 214 in accordance with an increase in fuel pressure is large in the half-lift condition in which the valve body 214 does not reach the maximum height position compared to a case where the valve body 214 reaches the maximum height position. Regarding the differential pressure, the cross-sectional area of the seat portion decreases when the valve body 214 has a small displacement amount and an influence of a decrease in static pressure increases in accordance with an increase in flow rate of the fuel flowing in the seat portion. Thus, in the case of the corrections of the first drive current 610 and the second drive current 611 when the fuel pressure increases, the corrections may be performed so that an increase in current of the first drive current 610 is larger than an increase in current of the second drive current 611. When the current value 611 of the second drive current 611 is set to be smaller than that of the first drive current 610, the current supplied to the solenoid 205 can be suppressed and thus a merit of suppressing power consumption is obtained.

Further, since it is possible to suppress the heating of the solenoid 205 in accordance with a decrease in current value, it is possible to suppress a change in temperature in accordance with the heating of the solenoid 205 and to suppress a change in resistance value of the solenoid 205. Since the current supplied to the solenoid 205 is dependent on the resistance value of the solenoid 205 compared to the Ohm's law, it is possible to suppress a change in current by suppressing a change in resistance value. Accordingly, an effect of improving the accuracy of the injection amount is improved. Additionally, the fuel pressure can be detected in such a manner that a signal of the pressure sensor 102 attached to the fuel pipe 105 is detected by the ECU 104.

Further, in order to suppress the air-fuel ratio variation for each cylinder, there is a case in which the injection pulse is corrected for each cylinder by the A/F sensor. Since the sensitivity given to the injection amount of the injection pulse is small, it is possible to obtain an effect of preventing an erroneous correction for the correction calculated by the A/F sensor and thus to accurately control the injection amount.

Further, the injection amount may be controlled by controlling the injection pulse width of the first hold current period in a condition that the valve body 214 is driven in the half-lift state. Since the current value is kept at a constant value in the first hold current period 610, it is possible to accurately control the magnetic attraction force regardless of the influence of a change in battery voltage VB.

Further, the first drive current 610 may be stopped before the valve body 214 reaches the maximum height position. When the first drive current 610 is stopped, the magnetic attraction force acting on the needle 202 decreases and thus a speed reduction effect can be obtained. Since the valve body 214 decreases in speed before reaching the maximum height position due to this effect, it is possible to reduce the bound of the valve body 214 caused when the needle 202 collides with the fixed core 207. As a result, it is possible to ensure the continuity of the flow rate when the half-lift region changes to the full-lift region. When the undulation of the injection amount is caused by the bound of the valve body 214 in a section in which the half-lift region changes to the full-lift region, there is a case in which the combustion of the engine becomes unstable. When the control method of the first embodiment is used, it is possible to accurately control the injection amount from the minute flow rate to the large flow rate and thus to obtain an effect of improving the combustion robustness of the engine.

In the current waveform 621, in a case where the fuel in one intake/exhaust stroke is divided and injected (split injection), when the number of split injections is large and the interval between the injections is small, the boost voltage VH does not return to the initial value and the fuel is injected in a condition that the boost voltage VH is small. In the current waveform 610 of the embodiment, since the application period of the boost voltage VH is short compared to the current waveform 621, there is an effect that a decrease in boost voltage VH can be suppressed. Since it is possible to accurately control the displacement amount of the valve body 214, it is possible to improve the accuracy of the injection amount in the split injection. As a result, since it is possible to improve the homogeneity of the air-fuel mixture for each injection, it is possible to suppress the PN. Further, since the application time of the boost voltage VH is shortened, it is possible to suppress the heating of the boost circuit 514 and the power consumption of the ECU 104 and thus to suppress the heating of the coil 205.

Next, when the injection pulse in the second drive current 611 is turned off, the supply of the current to the switching elements 505, 506, and 507 is stopped. When the supply of the current to the switching elements 506 and 507 is stopped, the current cannot flow to the ground potential (GND). For this reason, the voltage of the voltage source side terminal increases due to the counter electromotive force generated by the inductance of the fuel injection device 540 and charge returns from the ground potential (GND) to the high voltage source via the diode 509, the fuel injection device 540, and the diode 510 so that the charge is accumulated in the capacitor 533.

Second Embodiment

Figure 8:
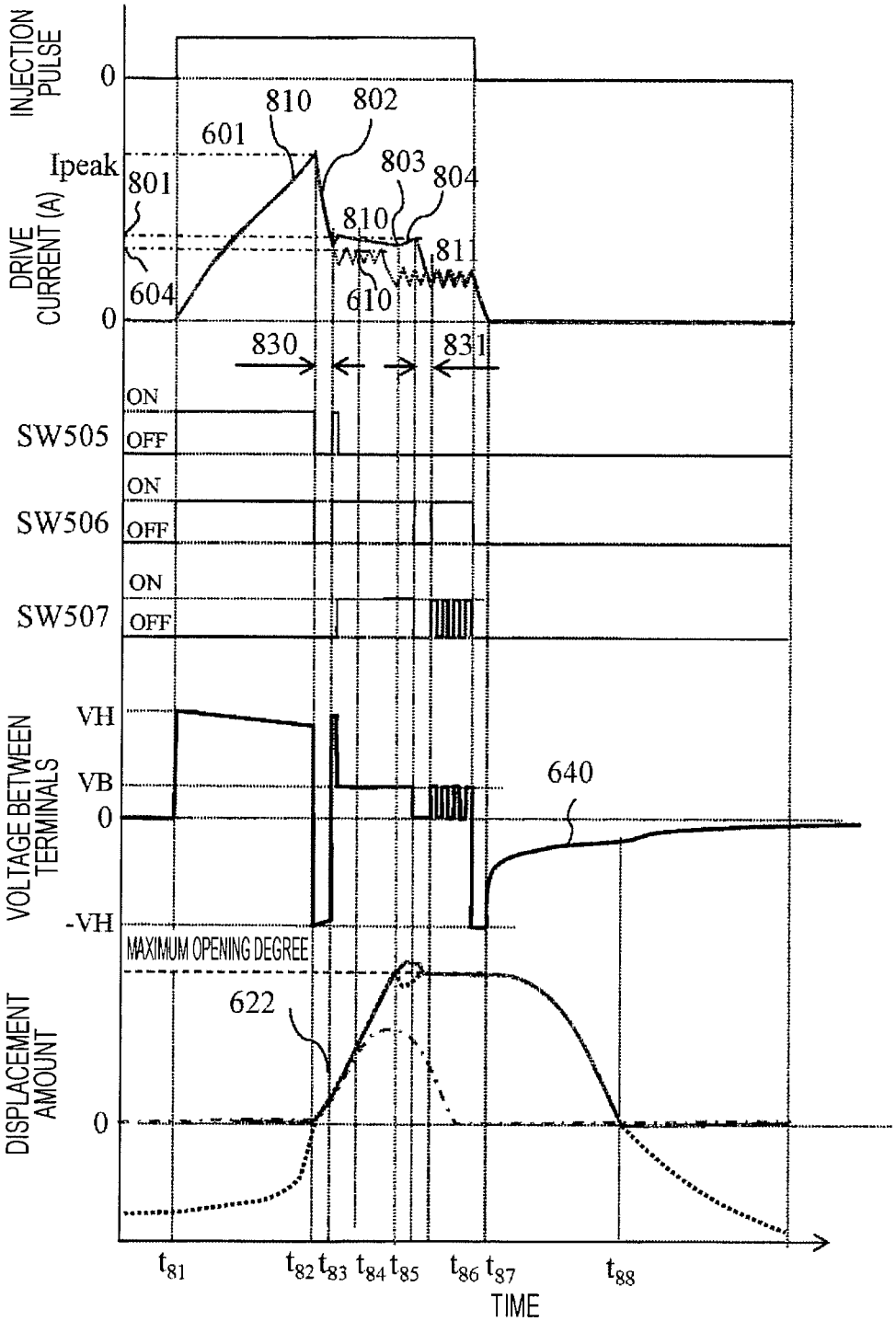
FIG. 8 is a diagram showing a relation of an injection pulse, a drive current supplied to a fuel injection device, a timing of a switching element of the fuel injection device, a voltage across terminals of a coil, and a behavior of a valve body and a needle in time according to a second embodiment.

Hereinafter, a current control method of a fuel injection device according to a second embodiment will be described with reference to FIG. 8. FIG. 8 is a diagram showing a relation of the injection pulse, the drive current supplied to the fuel injection device, a voltage Vinj between terminals of the solenoid 205 and the switching elements 505, 506, and 507 of the fuel injection device 540, and a behavior of the valve body 214 and the needle 202 in time according to the second embodiment of the invention. In the drawing, the first drive current 610 when using the current waveform of FIG. 6 is indicated by a dotted line. Additionally, the same reference numerals are given to the same components as those of FIG. 6. Further, the drive device of the second embodiment is the same as that of the first embodiment. A difference from the current waveform of the first embodiment is that a current value 701 of the first hold current period is higher than the current value 604, the boost voltage VH is applied to the solenoid 205 to reach the current 701 after the peak current $I_{peak}$ is stopped, and the boost voltage VH is applied to the solenoid 205 in the negative direction during a transition period from the first hold current period to the second hold current period.

In the current waveform 710 of the second embodiment, the supply of the current to the switching elements 505, 506, and 507 is stopped after reaching the peak current $I_{peak}$ and the boost voltage VH is applied to the solenoid 205 in the negative direction to rapidly decrease the current value as in the current 802. Additionally, a period 830 of applying the boost voltage VH in the negative direction may be set as a time in the CPU 501 or the IC 501 in advance or may be set as a timing in which the current value is lower than a threshold value. When the boost voltage VH in the negative direction is set by time, the time resolution is higher than that of the current value and the application time of the boost voltage VH can be accurately controlled. Accordingly, the accuracy of the time in which the current reaches the first drive current is improved. As a result, it is possible to accurately determine a minimum range in which the injection amount can be controlled in the half-lift state. Further, when the application time of the boost voltage VH in the negative direction is set to a timing in which the current value is lower than the threshold value after reaching the peak current value $I_{peak}$, it is possible to keep the current value at a constant value at a timing $t_{83}$ even when the resistance value of the solenoid 205 changes or the voltage value of the boost voltage VH changes. Accordingly, it is possible to suppress a decrease in magnetic attraction force caused by a decrease in current value. Additionally, the application time of the boost voltage VH in the negative direction may be a combination of the above-described time setting method and the method of setting the threshold value of the current. Specifically, the period 830 in which the boost voltage VH is applied in the negative direction after the current reaches the peak current value $I_{peak}$ may be set by time and the boost voltage VH is applied so that the current value reaches a current 801 at a timing in which the current is lower than the threshold value set by the CPU 501 or the IC 502 after the elapse of the period 830. As a result, since it is possible to finely set the time resolution and to keep the current value even when the battery voltage VB or the resistance value of the solenoid 205 changes, it is possible to improve the accuracy of the injection amount.

At the timing $t_{83}$ in which the period 830 ends, the current is supplied to the switching elements 505 and 506 and the boost voltage VH is applied to the solenoid 205 so that the current reaches the current 801. When the boost voltage VH is applied so that the current value reaches the current 801, the current value reliably reach the current 801 regardless of a change in battery voltage VB. Further, since the current value supplied to the solenoid 205 by the boost voltage VH is larger than that of the battery voltage VB according to the Ohm's law, it is possible to shorten a time from the timing $t_{83}$ to the first drive current 801 and to expand a control range in a direction in which the displacement amount of the valve body 214 is small. Thus, the minute injection amount can be controlled. As a result, since a required injection amount can be realized even in a case where an injection having a small split ratio is extremely required in the compression stroke as in the case where the split ratio of the injection amount is 9:1 in the intake stroke and the compression stroke in the condition of the multi-stage injection, it is possible to improve the homogeneity of the air-fuel mixture or to realize the weak stratified charge combustion which locally forms a lean air-fuel mixture around an ignition plug. Accordingly, it is possible to achieve both low fuel consumption and PN suppression.

When the current value reaches the current 801, the supply of the current to the switching element 505 is stopped and the current is supplied to the switching elements 506 and 507 so that the battery voltage VB is applied to the solenoid 205. Generally, on the assumption that the number of windings of the solenoid 205 is N and the magnetic flux generated in the magnetic circuit is φ, the voltage V between the terminals of the fuel injection device 540 is expressed by the term of −Ndφ/dt of the induced electromotive force and the product of the resistance R of the solenoid 205 caused by the Ohm's law and the current i flowing through the solenoid 205 as shown in Formula (1).

$$V = -N\frac{d}{dt} + R \cdot i \tag{1}$$

When the current value 801 of the first hold current period is larger than the current value 604 or in a condition that a change in magnetic flux in accordance with the valve opening operation of the needle 202 increases so that the induced electromotive force increases, there is a case in which the current flowing in the solenoid 205 decreases and does not reach the current 801 even when the battery voltage VB is applied to the solenoid 205 after reaching the first hold current period. In this case, in the first hold current period, the current switching control, that is, the switching of the supply of the current to the switching element 507 is not performed and the battery voltage VB is continuously applied to the solenoid 205. When the needle 202 reaches the maximum height position, a change in induced electromotive force caused by the movement of the needle 202 in the valve opening direction disappears and thus the gradient of the current value changes as in the current 804. Since the current value supplied to the solenoid 205 changes in accordance with a change in battery voltage VB when the injection amount in the half-lift region 742 is controlled while the battery voltage VB is continuously applied as in the current waveform 810, the magnetic attraction force acting on the needle 202 changes. For example, when the current is supplied to an in-vehicle device connected to the battery voltage VB during the first hold current period, the voltage value of the battery voltage VB decreases, the current value supplied to the solenoid 205 decreases, and the magnetic attraction force decreases. As a result, when the injection pulse width in the first hold current period is stopped, the maximum displacement of the valve body 214 and the valve open period decrease and thus the injection amount decreases.

The application time of the battery voltage VB after the timing $t_{83}$ or the supply of the current to the switching element 507 may be detected by the CPU 501 or the IC 502 and the target current value 801 of the first hold current period may be decreased when the battery voltage VB is continuously applied. The supply of the battery voltage VB may be normally performed by detecting a state where the current switching control of the first hold current period is not performed due to a decrease in battery voltage VB and changing the target current value 801 to perform the current switching control. As a result, since it is possible to keep the magnetic attraction force acting on the needle 202 even when the battery voltage VB changes, it is possible to accurately control the displacement amount of the valve body 214 in the half-lift region 742. As a result, since it is possible to accurately control the minute injection amount in the half-lift region 742, the homogeneity of the air-fuel mixture is improved and thus the PN can be suppressed. Specifically, the target current value 801 may be controlled to decrease when the battery voltage VB is continuously applied.

Further, when the battery voltage VB is continuously applied from the time at which the current reaches the current 801 after the timing $t_{83}$, the supply of the current to the switching element 507 is stopped, the current is supplied to the switching element 506, and the switching of the supply of the current to the switching element 505 is performed to determine the application of the boost voltage VH. Since the boost voltage VH is not easily influenced by a change in battery voltage VB, it is possible to reliably perform the current value switching control in the first hold current period of keeping the current 801 and thus to stably operate the valve body 214 in the half-lift condition. Further, since the current flowing in the solenoid 205 depends on the application voltage V from Formula (1), it is possible to keep the current value of the first drive current even in a condition that the current value 801 is high or the induced electromotive force in accordance with the movement of the needle 202 is large by using the boost voltage VH of which the voltage value is higher than that of the battery voltage VB to generate the first drive current, it is possible to increase the magnetic attraction force necessary for the valve opening operation. As a result, since it is possible to ensure the stability of the valve body 214 in the half-lift condition, the homogeneity of the air-fuel mixture is improved in accordance with the improvement in accuracy of the injection amount and the PN can be reduced. Further, the boost voltage VH may be used to generate the first drive current in a condition that the fuel pressure is high. Since the fluid pressure acting on the valve body 214 increases in a condition that the fuel pressure is high, the needle 202 and the valve body 214 can reach the maximum opening degree and thus the accuracy of the injection amount can be improved. Meanwhile, in the battery voltage VB, the application time width during the current switching control is smaller than that of the boost voltage VH and a difference between the current value 801 of the first drive current and the lower limit of the current value is small. Thus, since a change in magnetic attraction force in accordance with the switching of the current decreases, it is possible to improve the accuracy of the magnetic attraction force acting on the needle 202. As a result, since the accuracy of the injection amount is improved, the homogeneity of the air-fuel mixture is improved and the PN can be reduced.

Further, when the battery voltage VB is continuously applied even when the target current 801 is small, the application of the boost voltage VH may be switched. As a result, in the case of the normal drive state, the number of times of using the boost voltage VH is decreased to suppress the power consumption or the heating of the boost circuit 514. Further, when the battery voltage VB largely decreases unexpectedly, the valve open period and the displacement of the valve body 214 at the boost voltage VH are controlled to suppress the power consumption and the heating and to improve the robustness.

Further, a combination of the boost voltage VH and the battery voltage VB may be used to generate the first drive current. Specifically, a current control is performed such that the battery voltage VVB is applied to gently decrease the current when the current value reaches the current 801 after the timing $t_{83}$ and the boost voltage VH is applied so that the current value reaches the current 801 again after a predetermined time elapses or when the current value becomes lower than a predetermined threshold value. When the current value is made to reliably reach the current 801 by the application of the battery voltage VH and the current is gently decreased by the application of the battery voltage VB, it is possible to increase the current switching width in the first drive current and to decrease the number of times of switching the voltage. As a result, since it is possible to decrease a change in magnetic attraction force, it is possible to improve the accuracy of the injection amount.

Further, the second drive current may be generated by switching the application of the battery voltage VB after the first drive current changes to the second drive current before and after the needle 202 and the valve body 214 reach the maximum opening degree. Since the differential pressure acting on the valve body 214 decreases compared to the half-lift condition after the needle 202 reaches the maximum opening degree, the needle 202 and the valve body 214 can be kept in the valve opened state even when the battery voltage VB is selected from the application of the boost voltage VH. Further, since a range in which the boost voltage VH is used can be decreased by using the battery voltage VB for the second drive current even when the boost voltage VH is used for the first drive current, it is possible to suppress a decrease in boost voltage VH. As a result, since a decrease width of the boost voltage VH can be suppressed when the next injection is performed in the condition of the multi-stage injection, it is possible to suppress a change in injection amount for the first and second injections. Also, it is possible to improve the homogeneity of the air-fuel mixture and to suppress the PN.

Third Embodiment

Figure 9:
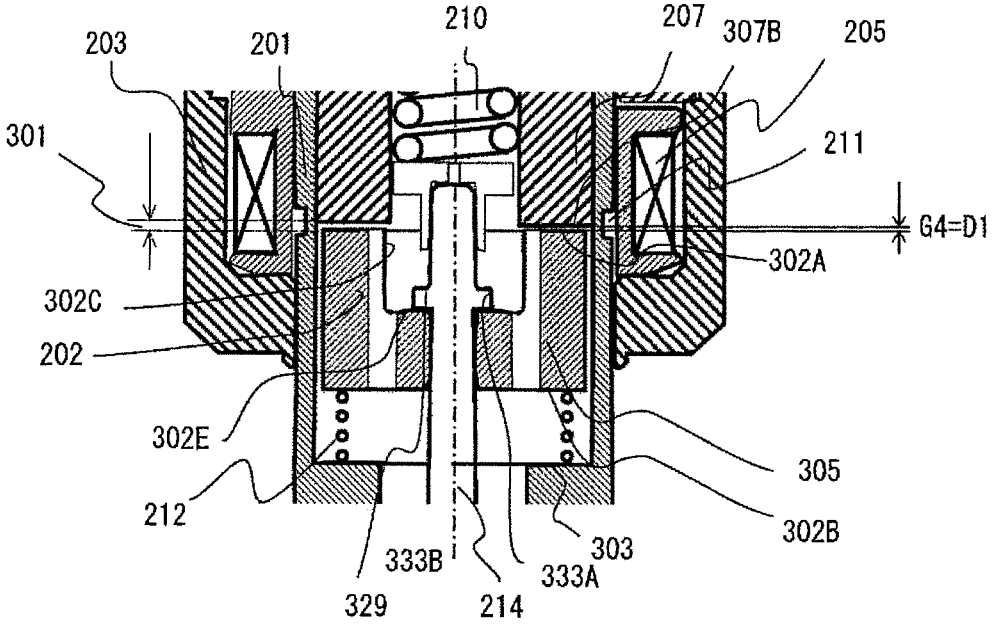
FIG. 9 is a diagram showing an enlarged cross-sectional view of a structure of a driving unit of a fuel injection device according to a third embodiment of the invention.
Figure 10:
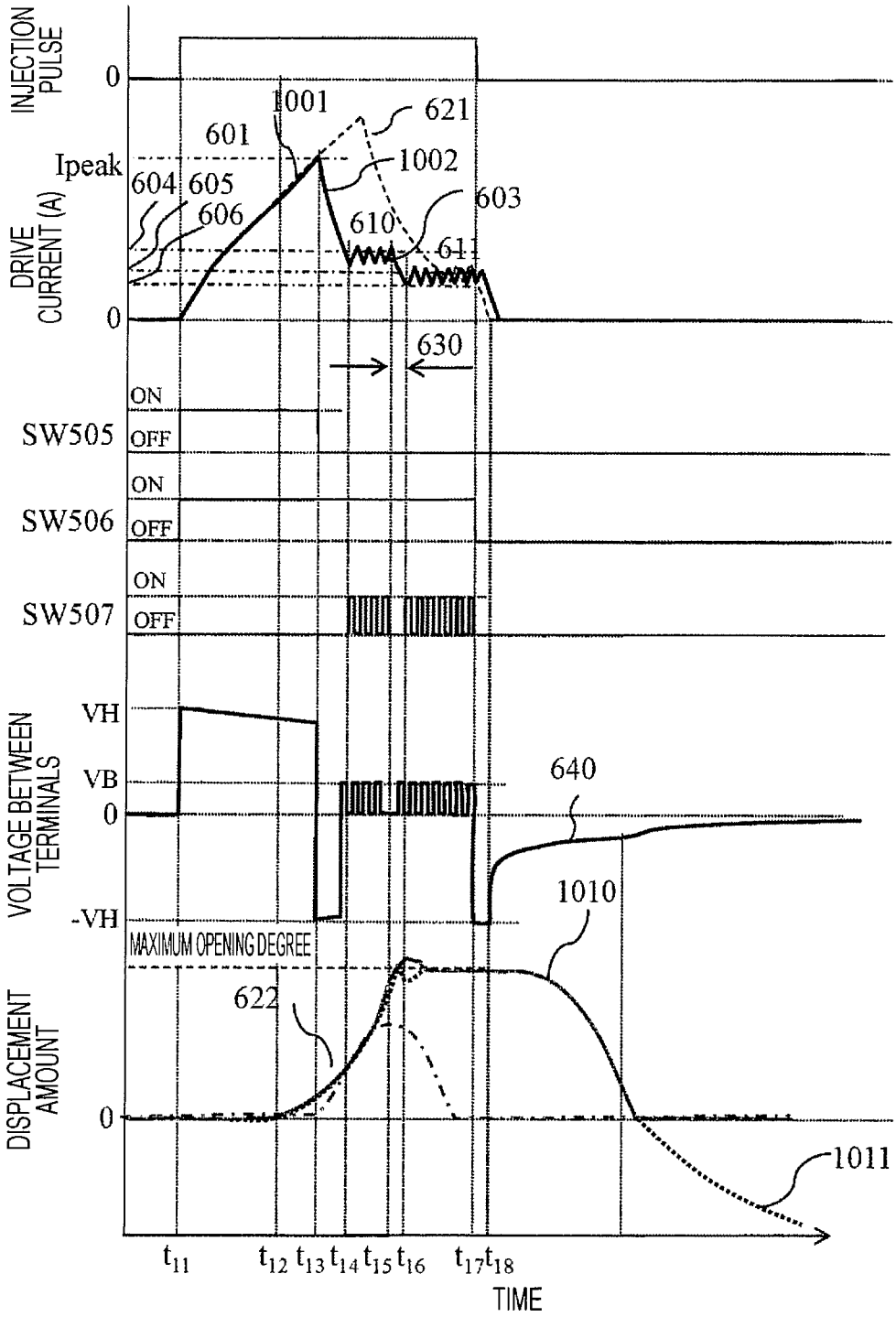
FIG. 10 is a diagram showing a relation of an injection pulse, a drive current supplied to the fuel injection device, a timing of a switching element of the fuel injection device, a voltage across terminals of a coil, and a behavior of a valve body and a needle in time according to the third embodiment of the invention.

Hereinafter, a configuration and an operation of a fuel injection device of a third embodiment and a method of controlling the fuel injection device will be described with reference to FIGS. 9 and 10. FIG. 9 is an enlarged cross-sectional view showing the vicinity of the needle 202 and the valve body 214 of the fuel injection device of the third embodiment. Additionally, in FIG. 9, the same reference numerals will be given to the same components as those of FIGS. 2 and 3. FIG. 10 is a diagram showing a relation of an injection pulse, a drive current supplied to the fuel injection device, a voltage Vinj between terminals of the solenoid 205 and the switching elements 505, 506, and 507 of the fuel injection device, and a behavior of the valve body 214 and the needle 202 in time according to the third embodiment of the invention. Additionally, in FIG. 10, the same reference numerals will be given to the same components as those of FIG. 6.

There is no difference in the fuel injection device between the first embodiment and the third embodiment, but there is a difference in that the third spring 234 and the intermediate member 220 are not provided and a gap between the contact portion near the needle 202 and the contact portion near the valve body 214 becomes zero while the valve body 214 and the valve seat 218 are in contact with each other.

The fuel injection device shown in FIG. 9 is a normally closed electromagnetic valve (an electromagnetic fuel injection device). Then, in a state where the current is not supplied to the solenoid 205, the valve body 214 is urged in the valve closing direction by a spring 901 which is a first spring and the valve body 214 comes into close contact with the valve seat 218 to become the valve closed state. In the valve closed state, a force which is generated by the return spring 212 corresponding to the second spring and is applied in the valve opening direction acts on the needle 202. At this time, since a force which is generated by the spring 910 and is applied to the valve body 214 is larger than a force generated by the return spring 212, the end surface 302E of the needle 202 contacts the valve body 214 so that the needle 202 is stopped. Further, the valve body 214 and the needle 202 are formed to be displaceable relatively and are enclosed in the nozzle holder 201. Further, the nozzle holder 201 includes an end surface 303 which is the spring seat of the second spring 212. A force which is generated by the spring 910 is adjusted at the time of assembly by the press-insertion amount of the spring retainer 224 which is fixed to the inner diameter of the fixed core 207.

When the valve body 214 is closed, a differential pressure is generated between the upper and lower portions of the valve body 214 by the fuel pressure and the valve body 214 is pressed in the valve closing direction by the differential pressure obtained by multiplying the fuel pressure by the pressure receiving area of the seat inner diameter at the valve seat position and the load of the spring 210. When the current is supplied to the solenoid 205 in the valve closed state, a magnetic field is generated in the magnetic circuit, a magnetic flux passes between the fixed core 207 and the needle 202, and a magnetic attraction force acts on the needle 202. The valve body 214 starts to be displaced in the direction of the fixed core 207 along with the needle 202 at a timing in which the magnetic attraction force acting on the needle 202 exceeds the differential pressure and the load of the set spring 210.

After the valve body 214 starts the valve opening operation, the needle 202 moves to the position of the fixed core 207 and the needle 202 collides with the fixed core 207. Although the needle 202 bounds back by the repelling force applied from the fixed core 207 after the needle 202 collides with the fixed core 207, the needle 202 is suctioned to the fixed core 207 by the magnetic attraction force acting on the needle 202 to be stopped. At this time, since a force is applied to the needle 202 in the direction of the fixed core 207 due to the second spring 212, it is possible to shorten a time until the rebounding converges. Since the rebounding operation is small, a time in which a gap between the needle 202 and the fixed core 207 is large is shortened and thus a stable operation can be performed even in the smaller injection pulse width.

The needle 202 and the valve body 202 having finished the valve opening operation in this way are stopped in the valve opened state. In the valve opened state, a gap is formed between the valve body 202 and the valve seat 218 and the fuel is injected from the injection hole 219. The fuel flows to the downstream direction while passing through the center hole provided in the fixed core 207 and the fuel passage hole provided in the needle 202.

When the supply of the current to the solenoid 205 is stopped, the magnetic flux generated in the magnetic circuit disappears and the magnetic attraction force also disappears. Since the magnetic attraction force acting on the needle 202 disappears, the needle 202 and the valve body 214 are pressed back to the valve closing position in which both members contact the valve seat 218 due to the differential pressure and the load of the spring 910.

Further, when the valve body 214 closes the valve from the valve opened state, the valve body 214 contacts the valve seat 218, the needle 202 is separated from the valve body 214, and the needle 202 to move in the valve closing direction. Then, the needle is returned to the initial position in the valve closed state by the return spring 212 after moving for a predetermined time. Since the needle 202 is separated from the valve body 214 at a timing in which the valve body 214 completes the valve opening operation, the mass of the movable member at the moment in which the valve body 214 collides with the valve seat 218 can be reduced by the mass of the needle 202. For this reason, since the collision energy generated by the collision with the valve seat 218 can be decreased, it is possible to suppress the bound of the valve body 214 generated when the valve body 214 collides with the valve seat 218.

In the fuel injection device of the embodiment, the valve body 214 and the needle 202 cause a relative displacement for a short time in which the needle 202 collides with the fixed core 207 for the valve opening operation or the valve body 214 collides with the valve seat 218 for the valve closing operation. Accordingly, there is an effect that the bound of the needle 202 with respect to the fixed core 207 or the bound of the valve body 214 with respect to the valve seat 218 is suppressed.

Next, a method of driving the fuel injection device of the third embodiment will be described with reference to FIG. 10. FIG. 10 is a diagram showing a relation of an injection pulse, a drive current supplied to the fuel injection device, a voltage Vinj between terminals of the solenoid 205 and the switching elements 505, 506, and 507 of the fuel injection device, and a behavior of the valve body 214 and the needle 202 in time according to the third embodiment of the invention. Additionally, in FIG. 10, the same reference numerals will be given to the same components as those of FIG. 6. A difference between FIG. 10 and FIG. 6 is that the peak current $I_{peak}$ is stopped and the first hold current period is selected after the valve body 214 starts to open the valve.

Next, a method of driving the valve body 214 of the invention will be described. First, when the injection pulse width Ti is transmitted from the CPU 501 to the driving IC 502 via the communication line 504 at a timing $t_{11}$, the switching element 505 and the switching element 506 are turned on. Accordingly, the boost voltage VH higher than the battery voltage VH is applied to the solenoid 205 and the drive current is supplied to the fuel injection device to rapidly raise the current. When the current is supplied to the solenoid 205, a magnetic attraction force is exhibited between the needle 202 and the fixed core 207. At a timing in which a force in the valve opening direction corresponding to the resultant force of the magnetic attraction force and the load of the second spring 212 exceeds the load generated in the spring 910 corresponding to the first spring as a force in the valve closing direction, the needle 202 and the valve body 214 start to be displaced and the fuel is injected from the fuel injection device.

A differential pressure which is generated by the pressure of the fuel is applied to the valve body 214 and the differential pressure acting on the valve body 214 is generated by a decrease in pressure of the front end portion of the valve body 214 according a decrease in pressure generated by a decrease in static pressure caused by a Bernoulli effect after the flow rate of the fuel at the seat portion increases in a range having a small passage cross-sectional area in the vicinity of the seat portion of the valve body 214. Since the differential pressure is largely influenced by the passage cross-sectional area of the seat portion, the differential pressure increases in a condition in which the displacement amount of the valve body 214 is small and the differential pressure decreases in a condition in which the displacement amount is large. Thus, there is a need to increase the magnetic attraction force at a timing in which the valve body 214 starts to open the valve from the valve closed state so that the displacement is small, the differential pressure increases, and the valve opening operation is difficult in a configuration of the fuel injection device of the third embodiment in which the needle 202 does not collide with the valve body 214. Since a timing $t_{13}$ at which the peak current value $I_{peak}$ stops is set to be later than a timing $t_{12}$ at which the valve body 214 becomes the valve opened state, it is possible to ensure the magnetic attraction force at a timing in which the differential pressure increases and to improve the stability when the valve is opened. As a result, since it is possible to accurately control the injection period and the displacement amount of the valve body 214 in the half-lift region, the accuracy of the injection amount is improved and the PN suppression effect is improved.

When the current reaches the peak current value $I_{peak}$, the supply of the current to the switching elements 505 and 507 is stopped and the current is supplied to the switching element 506 so that a voltage of about 0 V is applied to the solenoid 205. Accordingly, the current gently decreases from the peak current value $I_{peak}$ as in a current 1002. In the current waveform 1001 of the embodiment, the valve body 214 and the needle 202 are displaced in the valve opening direction to ensure a necessary magnetic attraction force and the peak current $I_{peak}$ is stopped at an early timing. Accordingly, it is possible to ensure the valve opening stability and to decrease the gradient of the displacement amount of the valve body 214. Further, since the timing $t_{13}$ of stopping the peak current $I_{peak}$ is set to a timing after the valve body 214 starts to open the valve, the magnetic attraction force generated by the needle 202 increases. Thus, even when the fuel pressure is large, the valve body 214 can be stably controlled until the valve opened state. As a result, since it is possible to control the displacement of the valve in the half-lift region while the displacement amount of the valve body 214 is stabilized, the accuracy of the injection amount is improved.

In the fuel injection device of the third embodiment, the valve opening start timing of the valve body 214 is largely dependent on the fuel pressure supplied to the fuel injection device. Since the differential pressure acting on the valve body 214 increases when the fuel pressure increases, the valve opening start timing is delayed. Thus, since an influence of the fuel pressure on the displacement amount of the valve body 214 is large, an effect of improving the accuracy of the injection amount is improved when the control method described in the first and second embodiments is applied to the fuel injection device of the third embodiment and thus the PN can be suppressed.

Fourth Embodiment

Figure 11:
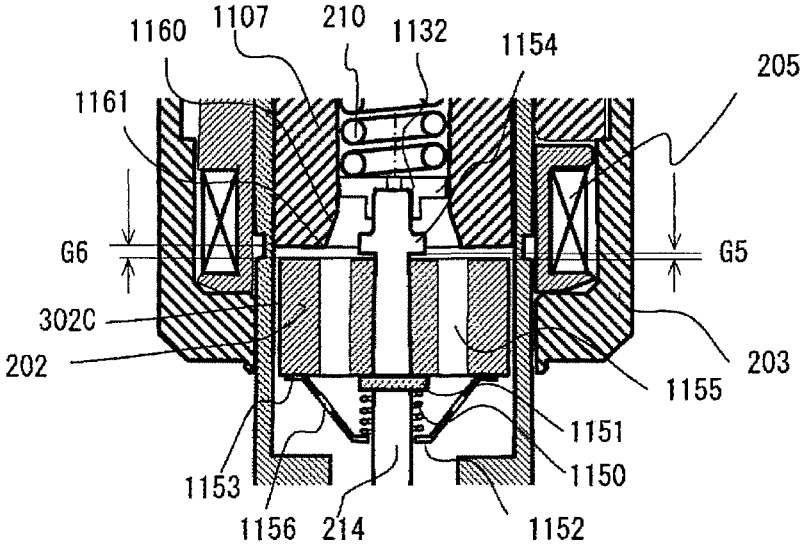
FIG. 11 is an enlarged cross-sectional view showing a structure of a driving unit of a fuel injection device according to a fourth embodiment of the invention.

Hereinafter, a configuration and an operation of a fuel injection device of a fourth embodiment will be described with reference to FIG. 11. FIG. 11 is an enlarged cross-sectional view showing the vicinity of the valve body 114 and the needle 202 of the fuel injection device of the fourth embodiment. Additionally, in FIG. 11, the same reference numerals will be given to the same components as those of FIGS. 2 and 3.

A difference from the fuel injection device of the first embodiment shown in FIG. 11 is that the third spring 234 and the intermediate member 320 are not provided and a stopper member 1151 and a thin plate member 1152 are provided.

The stopper member 1151 is fixed to the valve body 214 by press-inserting or welding. Further, the thin plate member 1151 is weld-fixed to the needle 202 by a lower end surface 1153 of the needle 202. The second spring 1150 is disposed between the stopper member and the thin plate member 1152 and urges the needle 202 in the valve closing direction. A gap G5 is provided between the valve body 214 and the needle 202 and a value obtained by subtracting the gap G5 from the gap G6 between the needle 202 and the fixed core 207 becomes the maximum height position of the valve body 214. Additionally, the thin plate member 1152 is provided with a plurality of fuel passage holes 1156 in the circumferential direction and the fuel which flows from the upstream side of the fuel injection device flows toward the downstream side while passing through the fuel passage hole 1155 and the fuel passage hole 1156 of the needle 202.

Next, an operation of the fuel injection device will be described. Additionally, the configuration of the drive circuit and the current generation means are the same as those of the first embodiment. When the current is supplied to the solenoid 205, a magnetic attraction force acts on the needle 202. The needle 202 starts to be displaced in the valve opening direction at a timing in which the magnetic attraction force exceeds the load of the second spring 1150. When the needle 202 displaces the gap G5, the needle 202 collides with a lower end surface of a flange portion 1154 of the valve body 214 and the valve body 214 starts to open the valve so that the fuel is injected from the injection hole 219. When the needle 202 displaces the gap G6, the needle 202 collides with the fixed core 207 and the needle 202 and the valve body 214 reach the maximum height position. An effect of opening the valve by the collision between the needle 202 and the valve body 214 is the same as that of the first embodiment, but since the third spring 234 and the intermediate member 320 are not provided in the configuration shown in the fourth embodiment, the number of components is small and the cost can be reduced. However, since the second spring 1150 urges the needle 202 in the valve closing direction instead of the valve opening direction in which the bound of the needle 202 is suppressed when the needle 202 collides with the fixed piece 207, it is difficult to stabilize the bound with respect to the valve body 214. Thus, since a relation between the injection amount and the injection pulse becomes non-linear in the full-lift region after the needle 202 reaches the valve opening position, a change in injection amount may occur. In the fuel injection device shown in FIG. 11, the boost voltage VH may be applied to the solenoid 205 in the negative direction before the needle 202 reaches the maximum height position after the current is supplied to the solenoid 205 to reach the first drive current. Asa result, the magnetic attraction force acting on the needle 202 rapidly decreases and the needle 202 is decelerated by the differential pressure acting on the valve body 214 and the first spring 210. Accordingly, since a speed at which the needle 202 collides with the fixed core 207 decreases, the bound of the needle 202 can be suppressed. As a result, since the bound of the valve body 214 is reduced, it is possible to improve the accuracy of the injection amount after the valve body 214 reaches the maximum height position. Further, when a surface facing the fixed core 207 in the needle 202 is substantially flat, the fuel passage hole 1155 of the needle 202 is blocked by the fixed core 207 and a gap between the flange portion 1154 of the valve body 214 and the inner diameter of the fixed core 207 decreases, an effective cross-sectional area of the fuel passage cannot be easily ensured. In this case, a tapered surface 1160 may be provided in the inner diameter of the core 207 to ensure a fuel passage between the fixed core 207 and the valve body 214. Further, the position of the fuel passage of the needle 202 in the radial direction may be located near the outer diameter in relation to the outer diameter of the flange portion 1154 of the valve body 214. By this effect, it is possible to suppress the cross-sectional area of the fuel passage of the needle 202 from being decreased by the flange portion 1154. Further, since it is possible to increase the contact area between the valve body 214 and the needle 202, there is an effect of suppressing the collision load generated when the needle 202 collides with the valve body 214. As a result, since it is possible to suppress the abrasion of the collision surface between the valve body 214 and the needle 202, it is possible to suppress a change in injection amount and to improve the accuracy of the injection amount. Further, a longitudinal end portion 1161 of the tapered surface 1160 in a surface facing the needle in the fixed core 207 may be located near the inner diameter in relation to the outer diameter of the fuel passage hole 1155 of the needle 202. When a gap between the needle 202 and the fixed core 207 decreases, the fuel pressure between the needle 202 and the fixed core 207 increases due to a squeeze effect and a differential pressure is generated in a direction in which the movement of the needle 202 is disturbed. Since the outer diameter of the fuel passage hole 1155 of the needle 202 is located at the outer diameter in relation to the longitudinal end portion 1161 of the tapered surface 1160, an excluded flow amount between the needle 202 and the fixed core 207 in accordance with the movement of the needle 202 easily flows to the fuel passage hole 1155 of which the cross-sectional area of the fuel passage increases and thus there is an effect of reducing the differential pressure acting on the needle 202. Further, when the gap between the valve body 214 and the fixed core 207 and the cross-sectional area of the fuel passage of the needle 202 are large, it is possible to suppress pressure loss generated when the fuel passes through the fuel passage. Accordingly, it is possible to decrease the vertical differential pressure between the valve body 214 and the needle 202 and to decrease the differential pressure acting on the valve body 214 and the needle 202. As a result, when an influence of the non-linear differential pressure acting on the needle 202 is suppressed, the needle 202 and the valve body 214 behave stably and thus the accuracy of the injection amount can be improved. Further, since the differential pressure acting on the valve body 214 and the needle 202 increases in accordance with an increase in fuel pressure, it is possible to operate the needle 202 and the valve body 214 in a condition of a high fuel pressure by decreasing the differential pressure. Since the particle diameter of the fuel injected from the injection hole 219 can be decreased in accordance with an increase in fuel pressure, the homogeneity of the air-fuel mixture is improved and thus the PN can be suppressed.

Further, the fuel injection device described in the fourth embodiment may be controlled by the current waveform control method described in the first, second, and third embodiments.

Fifth Embodiment

Figure 12:
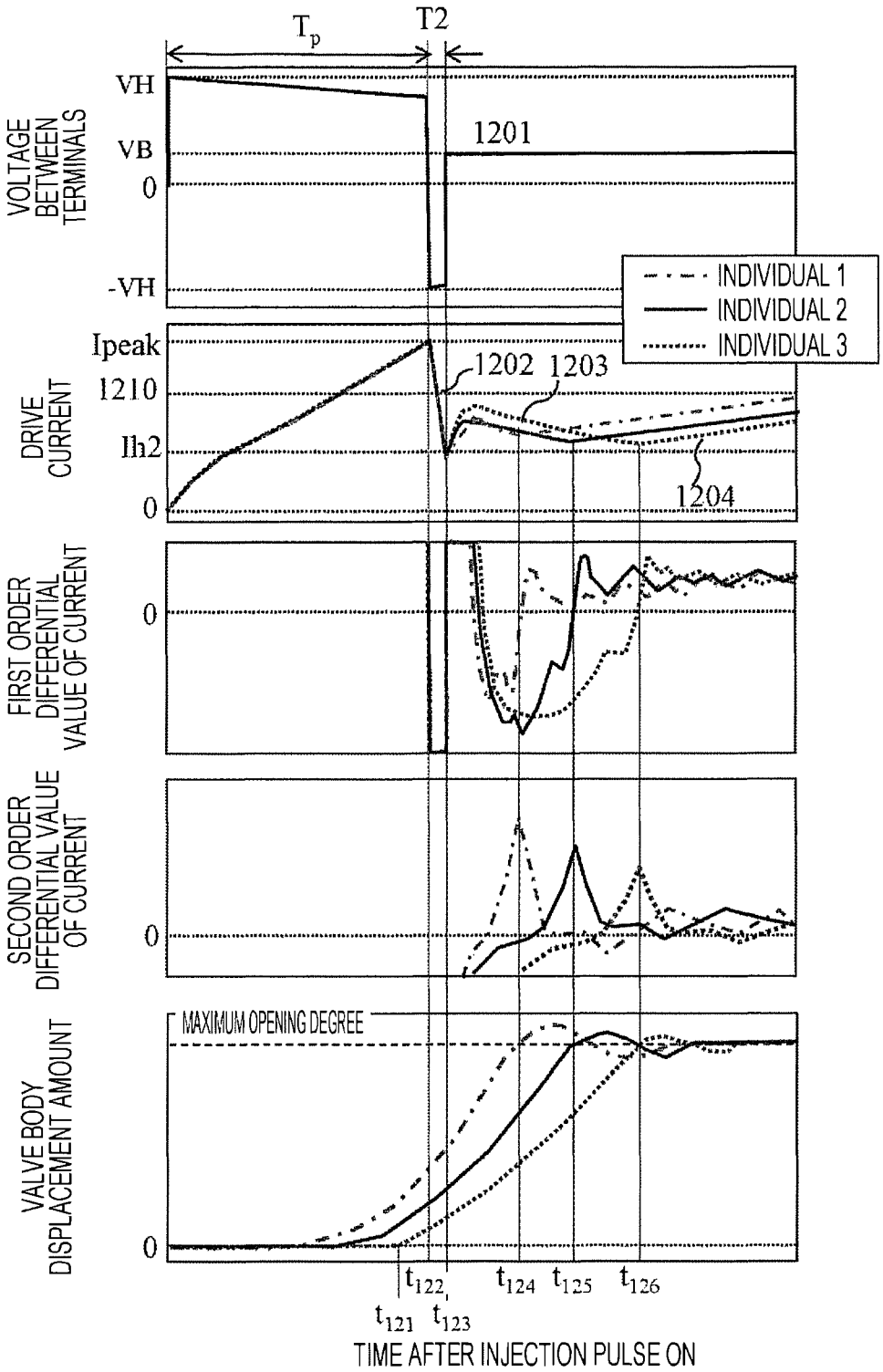
FIG. 12 is a diagram showing a relation of a voltage across terminals, a drive current, a first order differential value of the current, a second order differential value of the current, and a valve body displacement amount in time in three fuel injection devices having different valve opening start and completion timings in a condition in which the valve body according to the fourth embodiment of the invention reaches a maximum opening degree.
Figure 13:
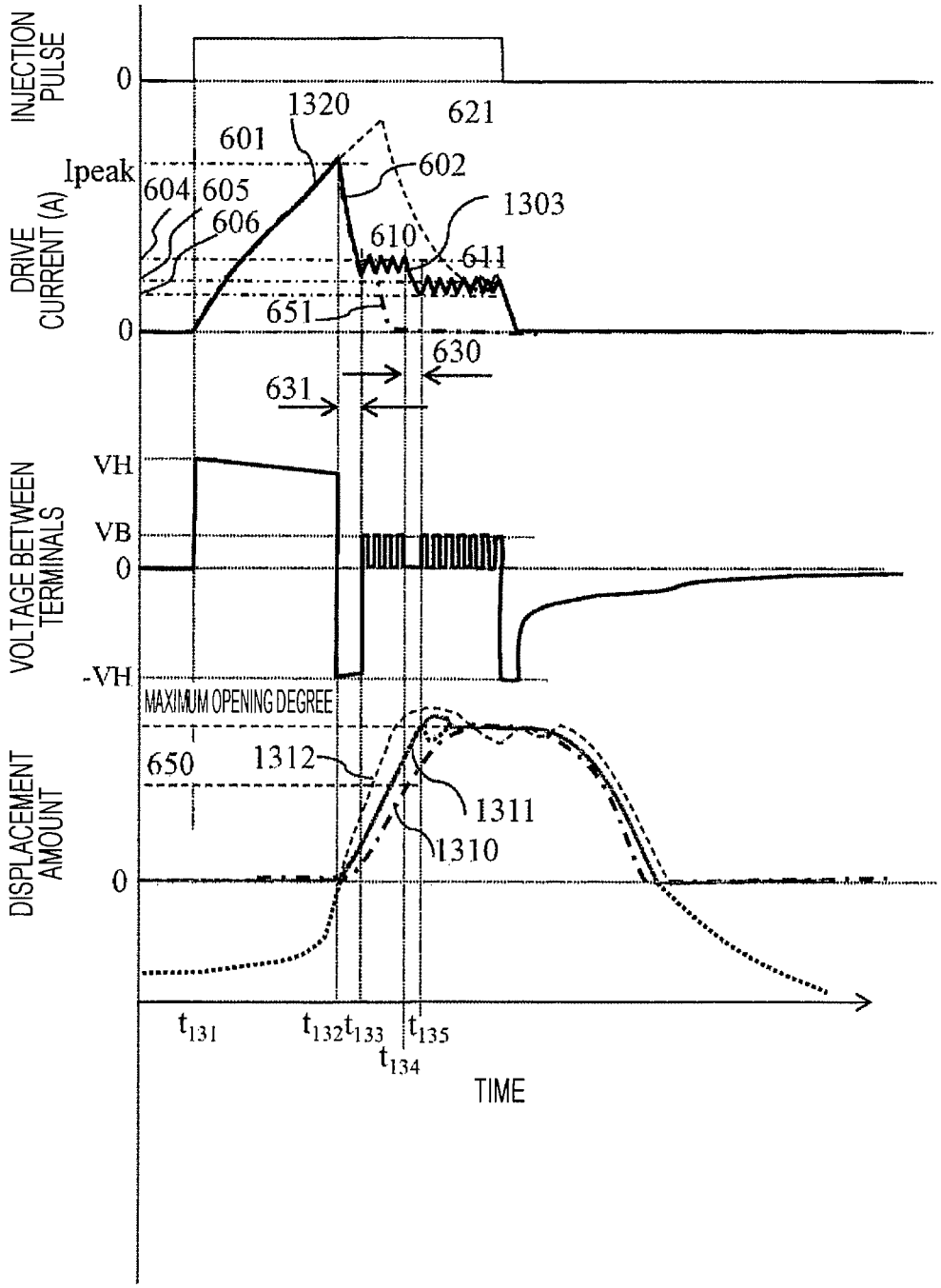
FIG. 13 is a diagram showing a relation of an injection pulse, a drive current supplied to a fuel injection device, a timing of a switching element of the fuel injection device, a voltage across terminals of a coil, and a behavior of a valve body and a needle in time according to a fifth embodiment of the invention.

Hereinafter, a control method and a detection method for a change in operation of a valve of the valve body 214 of the fuel injection device of each cylinder of the fifth embodiment will be described with reference to FIGS. 12 and 13. FIG. 12 is a diagram showing a relation of a voltage Vinj between terminals, a drive current, a first order differential value of the current, a second order differential value of the current, and a valve body displacement amount in time of three fuel injection devices having different valve opening start and completion timings in a condition in which the valve body 214 of the embodiment of the invention reaches a maximum opening degree. FIG. 13 is a diagram showing a relation of an injection pulse, a drive current supplied to the fuel injection device, a voltage Vinj between terminals of the solenoid 205, and a behavior of the valve body 214 and the needle 202 in time according to the fifth embodiment of the invention. Additionally, in FIG. 13, the same reference numerals will be given to the same components as those of FIG. 6. Additionally, in the drawings, the displacement values of the valves of three fuel injection devices having different forces acting on the valve body 214 in the valve closing direction are denoted by a dashed line, a solid line, and a one-dotted chain line.

First, a method of detecting a valve opening completion timing which is a timing in which the valve body 214 reaches the maximum height position (the maximum opening degree) will be described with reference to FIG. 12. FIG. 12 is a diagram showing a relation of a voltage Vinj between terminals of the solenoid 205, a drive current, a first order differential value of the current, a second order differential value of the current, and a displacement amount of the valve body 214 in time after the injection pulse is turned on. Additionally, the drive current, the first order differential value of the current, the second order differential value of the current, and the displacement amount of the valve body 214 of FIG. 12 are shown as three profiles of the fuel injection devices having different valve body operation timings in accordance with a change in force acting on the needle 202 and the valve body 114 due to a tolerance. From FIG. 12, the boost voltage VH is first applied to the solenoid 205 to rapidly increase the current and increase the magnetic attraction force acting on the needle 202. Next, the needle 202 collides with the valve body 214 so that the valve body 214 starts to open the valve. The peak current value $I_{peak}$ or the peak current arrival time Tp and the voltage interruption period T2 may be set so that the valve opening start timing of the valve body 214 of each of individuals 1, 2, and 3 of the fuel injection devices of different cylinders comes before the timing $t_{123}$ in which the drive current reaches the peak current value $I_{peak}$ and the voltage interruption period T2 ends. Additionally, the voltage interruption period T2 indicates a time in which the reverse voltage VH is applied in the negative direction after the end of the peak current $I_{peak}$. Since a change in application voltage to the solenoid 205 is small in a condition that the battery voltage VB is continuously applied so that a predetermined voltage value 1201 is supplied, the needle 202 starts to be displaced from the valve closing position and then a change in magnetic resistance caused by a change in gap between the needle 202 and the fixed core 207 can be detected as a change in induced electromotive force. Since the gap between the needle 202 and the fixed core 207 decreases when the valve body 214 and the needle 202 start to be displaced, the number of the magnetic fluxes passing between the needle 202 and the fixed core 207 increases, the induced electromotive force increases, and the current supplied to the solenoid 205 gently decreases as in a line 1203. Since a change in induced electromotive force in accordance with a change in gap is small at a timing in which the needle 202 reaches the fixed core 207, that is, a timing (a valve opening completion timing) in which the valve body 214 reaches the maximum opening degree, the current value gently increases as in a line 1204. The magnitude of the induced electromotive force is influenced by the current value other than the gap, but since a change in current is small in a condition that the valve lower than the boost voltage VH is applied as in the battery voltage VB, it is possible to easily detect a change in induced electromotive force in accordance to a change in gap in terms of the current.

Regarding the individuals 1, 2, and 3 of the cylinders of the above-described fuel injection devices, the timings $t_{113}$, $t_{114}$, and $t_{115}$ at which the first order differential value of the current becomes zero may be detected as the valve opening completion timing by performing a first order differentiation of the current in order to detect a timing in which the valve body 214 reaches the maximum opening degree as a point in which the drive current changes from a decrease state to an increase state.

Further, in the configurations of the magnetic circuit and the drive unit in which the induced electromotive force generated by a change in gap is small, there is a case in which the current does not necessarily decrease in accordance with a change in gap. However, since the gradient of the current, that is, the differential value of the current changes at the valve opening completion timing, it is possible to detect the valve opening completion timing by detecting the maximum value of the second order differential value of the current detected by the drive device. Accordingly, it is possible to stably detect the valve opening completion timing regardless of the limitation of the magnetic circuit, the inductance, the resistance value, or the current.

Even in the configuration of the movable valve in which the valve body 214 and the needle 202 are integrated with each other, the valve opening completion timing can be also detected by the same principle as that of the detection of the valve opening completion timing described in the structure in which the valve body 214 and the needle 202 are separated from each other.

Additionally, the peak current value $I_{peak}$ and the current interruption period T2 may be adjusted so as not to reach a target current value 1210 set in the IC 502 in advance during a period in which the voltage value 1201 is supplied from the battery voltage source VB after the application of the boost voltage VH in the negative direction is stopped. Since the drive device is controlled so that the current 1210 becomes a constant value when the drive current reaches the target current value 1210 before the valve body 214 reaches the maximum opening degree by this effect, the first order differential value of the current repeatedly passes through a point 0. Accordingly, it is possible to solve a problem in which a change in induced electromotive force cannot be detected by the differential value of the drive current.

Further, the switching elements 605, 606, and 607 are controlled so that the application of the voltage or the boost voltage VH in the negative direction is stopped (so that a voltage of 0 V is applied) from a state where a constant voltage value 1202 is applied, the current value reaches the current 704 of FIG. 7, and then the application of the battery voltage VB is repeatedly switched to the current 703. At time in which the current value 1210 is obtained after the injection pulse width Ti is turned on is different in accordance with a change in valve opening completion timing due to a change in fuel pressure and a difference in valve body 214. The magnetic attraction force at the time of stopping the injection pulse width Ti is largely dependent on the value of the drive current when the injection pulse width Ti is turned off. When the drive current is large, the magnetic attraction force increases and the valve closing delay time increases. In contrast, when the drive current at the time of turning off the injection pulse width Ti is small, the suction force decreases and the valve closing delay time decreases. As described above, since it is desirable that the current value at the timing of turning off the injection pulse width Ti in a condition that the valve opening completion state is detected become the same current 703 in different individuals, the timing of applying the boost voltage VH in the negative direction from the constant voltage value 1102 or the timing of stopping the application of the voltage may be controlled by the time after the injection pulse width Ti is turned ON or the time after the peak current value $I_{peak}$ is obtained.

The current waveform may be switched so that the target current value 1210 becomes a small value and the application of the battery voltage VB is repeatedly switched during the first current hold period after the valve opening completion timing of the fuel injection device of each cylinder is detected. Further, in the current waveform of FIG. 12 of the fifth embodiment of the invention, a correction of increasing the peak current value $I_{peak}$ or shortening the voltage interruption time T2 or a correction of increasing the peak current and shortening the voltage interruption time may be performed in order to increase the current value at the timing $t_{123}$.

When the battery voltage VB decreases due to the supply of the current to the in-vehicle device, the magnetic attraction force acting on the needle 202 decreases and thus the needle 202 and the valve body 214 may be displaced unstably. When the peak current $I_{peak}$ is set to a large value, the kinetic energy obtained when the needle 202 collides with the valve body 214 can be increased and the magnetic attraction force acting on the needle 202 after the valve body 214 starts to open the valve can be increased. Accordingly, the stability of the displacement of the valve body 214 is improved and the accuracy of the injection amount can be improved. Since the magnetic attraction force acting on the needle 202 can be kept at a high value when the current value at the timing $t_{123}$ is large, the stability of the valve body 214 is further improved.

Next, a method of correcting the second drive current from the valve opening completion timing detection information will be described with reference to FIG. 13. Regarding the displacement amount, the displacement of the valve body 214 is indicated as a displacement 1310, a displacement 1311, and a displacement 1312 in order in which a force acting on the valve body 214 in the valve closing direction is large. The force of the valve body 214 in the valve closing direction is the resultant force of the differential pressure acting on the valve body 214 and the first spring 210. In a condition that the same current waveform 1320 is supplied to the fuel injection device of each cylinder, the force in the valve closing direction is large, the gradient of the displacement of the valve after the valve body 214 start to open the valve is small, and the timing in which the valve body 214 reaches the maximum opening degree is delayed. Regarding the displacement 1312, since the timing of stopping the first drive current is late compared to the valve opening completion timing, the needle 202 and the valve body 214 cannot be decelerated in time and the bound of the valve body 214 increases. As a result, there is a case in which a relation between the injection pulse and the injection amount after the full-lift is non-linear and the injection amount cannot be continuously controlled. Regarding the displacement 1310, since the timing of stopping the first drive current is fast compared to the valve opening completion timing, the magnetic attraction force acting on the needle 202 decreases and the speed of the needle 202 and the valve body 214 largely decreases. As a result, since it is not possible to ensure the magnetic attraction force necessary for the valve opening operation and the valve opening completion timing is delayed, the behavior of the valve body 214 may become unstable.

In a case where each fuel injection device has a different valve opening completion timing, it is possible to ensure a stable behavior in a half-lift state of each individual by determining the timing of stopping the first drive current using the information of the valve opening completion timing detected for the fuel injection device of each cylinder. Accordingly, since the accuracy of the injection amount is improved, it is possible to improve the homogeneity of the air-fuel mixture and to suppress the PN. Further, since it is possible to appropriately adjust the injection amount with respect to a change in engine rotation speed by ensuring the continuity of the flow rate from the half-lift to the full-lift, it is possible to improve the drivability. Specifically, the current waveform may be set so that the timing $t_{134}$ of stopping the first drive current is fast in the individual 1310 in which the valve opening completion timing is slow and the timing $t_{134}$ of stopping the first drive current is slow in the individual 1312 in which the valve opening completion timing is fast. In FIG. 13, a voltage of about 0 V is applied to the solenoid 205 when the first drive current changes to the second drive current so that the current gently decreases as in the current 1303, but the boost voltage VH in the negative direction may be applied so that the current fast changes to the second drive current 611. Since the boost voltage VH in the negative direction is used when the first drive current changes to the second drive current, the bound of the valve body 214 can be reduced by decelerating the needle 202 in accordance with a decrease in magnetic attraction force immediately before the valve opening completion timing after a large magnetic attraction force is applied to the needle 202 before the valve opening completion timing to ensure the stability of the valve body 214. As a result, it is possible to reduce the PN by improving the accuracy of the injection amount in the half-lift and to improve the drivability by ensuring the continuity of the flow rate after the full-lift.

Regarding the voltage applied to the solenoid 205 when the first drive current changes to the second drive current, the setting of the current waveform may be changed so that the boost voltage VH in the negative direction is applied in a condition that the fuel pressure is low and a voltage of about 0 V is applied in a condition that the fuel pressure is high. Since the differential pressure acting on the valve body 214 is small in a condition that the fuel pressure is low, a time taken until the needle 202 and the valve body 214 are decelerated after the first drive current is stopped and the magnetic attraction force decreases is long. Further, since the differential pressure acting on the valve body 214 is small in a condition that the fuel pressure is high, a time taken until the needle 202 and the valve body 214 are decelerated after the first drive current is stopped and the magnetic attraction force decreases is short. Thus, since the application voltage at the time of stopping the first drive current is changed in response to the fuel pressure, the needle 202 can be decelerated at an appropriate timing and the bound of the valve body generated after the valve body 214 reaches the maximum opening degree can be reduced. As a result, since it is possible to continuously control the injection amount, the drivability is improved.

Further, since the differential pressure acting on the valve body 214 increases when the fuel pressure increases, the valve opening completion timing is delayed. The valve opening completion timing for each fuel pressure in each fuel injection device may be detected by the ECU 104 and may be set in the CPU 501 in advance. Additionally, the valve opening completion timing may be acquired in at least two points having different pressures. When an approximate equation is obtained from the information of detecting the valve opening completion timing at a plurality of points and an interpolation is performed, it is possible to accurately calculate a change in valve opening completion timing even when the fuel pressure is changed. Specifically, the timing of stopping the first drive current may be delayed as the fuel pressure increases. The valve opening completion timing is dependent on the differential pressure acting on the valve body 214 and the needle 202 and the displacement profile of the needle 202 determining the valve opening start timing of the valve body 214. Due to the influence of the tolerance of each fuel injection device, the sensitivities of the fuel pressure and the valve opening completion timing are different for each fuel injection device. In the control method of the fifth embodiment of the invention, a relation between the fuel pressure and the valve opening completion timing may be detected for the fuel injection device of each cylinder and the first drive current stop timing may be determined based on the detection information. As a result, since it is possible to improve the accuracy of the injection amount and the stability of the valve body 214 in the half-lift and to reduce the bound of the valve body 214 in the full-lift, it is possible to improve the drivability by ensuring the continuity of the flow rate.

Sixth Embodiment

Figure 14:
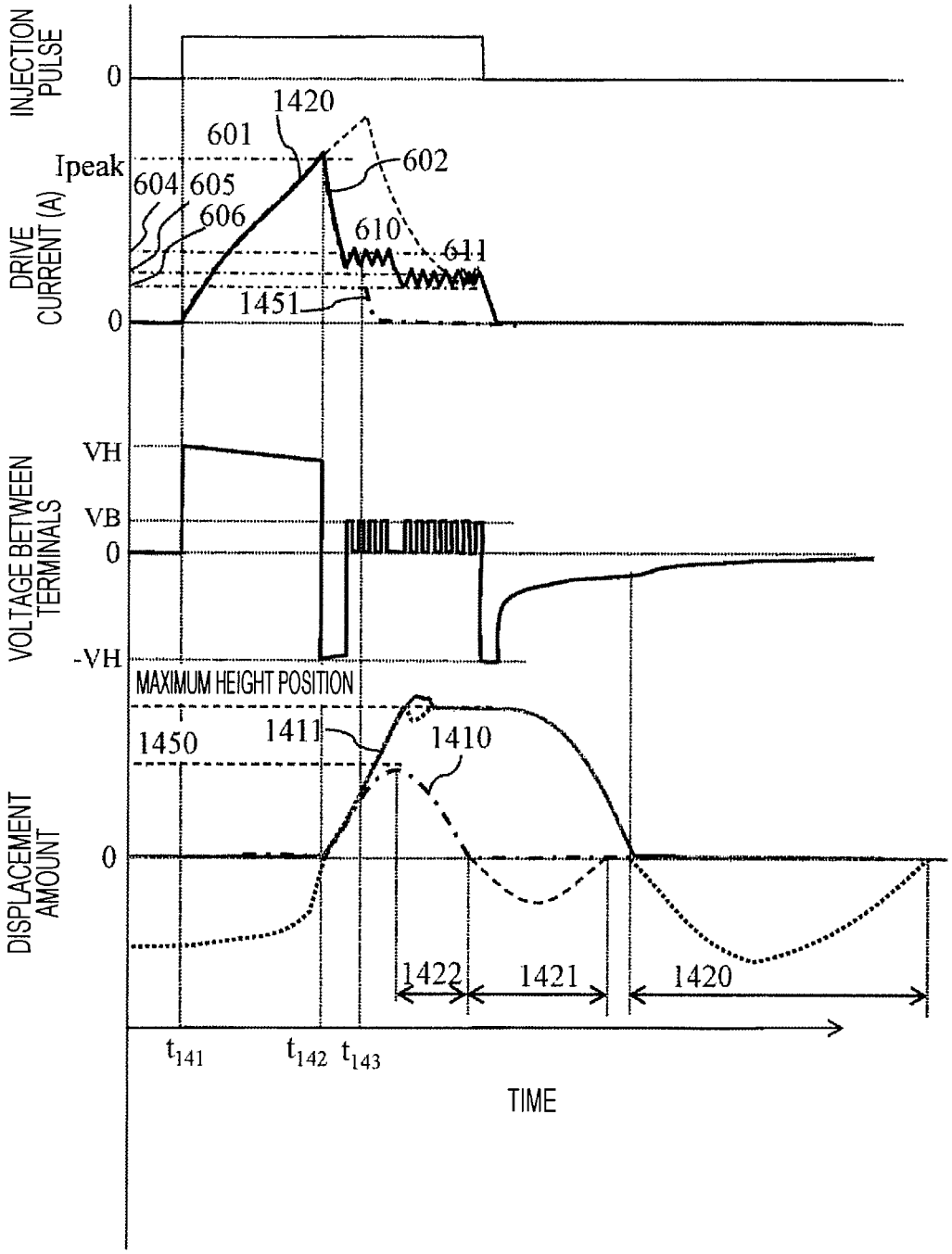
FIG. 14 is a diagram showing a relation of an injection pulse, a drive current supplied to a fuel injection device, a voltage across terminals of a coil, and a behavior of a valve body and a needle in time according to a sixth embodiment of the invention.

An injection control method of the split injection of the sixth embodiment of the invention will be described with reference to FIG. 14. FIG. 14 is a diagram showing a relation of an injection pulse, a drive current supplied to a fuel injection device, a voltage Vinj between terminals of the solenoid 205, and a behavior of the valve body 214 and the needle 202 in time according to the sixth embodiment of the invention. Additionally, in FIG. 14, the same reference numerals will be given to the same components as those of FIG. 6. Regarding the valve displacement amount of the drawing, in a case where the injection pulse is stopped at the first drive current and the valve body 214 is driven in the half-lift condition, the displacement amount of the valve body 214 is indicated by a one-dotted chain line and the displacement amount of the needle 202 is indicated by a dashed line. Then, the displacement amount of the valve body 214 driven in the full-lift condition is indicated by a solid line and the displacement amount of the needle 202 is indicated by a dotted line. Additionally, the configurations of the fuel injection device and the drive device of the sixth embodiment are the same as those of the first to fifth embodiments.

From FIG. 14, in the current 1451 in which the injection pulse is stopped at the first drive current and which corresponds to the half-lift condition, the maximum height position 1450 of the valve body 214 is smaller than that of the full-lift condition. For this reason, the displacement amount of the valve body 214 until the valve body 214 closes the valve after the stop of the injection pulse is small. When the displacement amount of the valve body 214 is small, a period 1422 in which the valve body 214 reaches the maximum height position 1450 so that the speed of the valve body 214 becomes zero and then the valve body is accelerated again in the valve closing direction is short and thus a speed at which the valve body 214 contacts the valve seat 218 is small. The time in which the needle 202 is separated from the valve body 214 and is returned to the initial position after the valve body 214 closes the valve is influenced by the valve closing speed of the valve body 214 and thus the time in which the needle 202 reaches the initial position becomes long when the valve closing speed of the valve body 214 is high. Thus, compared to the full-lift condition, the period 1422 corresponding to the time until the needle 202 returns to the original position is short and the injection interval of the split injection can be decreased in the half-lift condition in which the maximum height position is small.

In the control method of the sixth embodiment of the invention, the interval of the injection pulse may be set to be small after the first and second injections in the condition of the split injection in the half-lift condition compared to the case of the fuel injection in the full-lift condition. When the interval of the injection pulse in the half-lift condition is set to be small, a control of forming the air-fuel mixture is easily performed by the fuel injection. Then, when the air-fuel mixture having a locally high homogeneity is formed in the vicinity of the ignition plug, it is possible to reduce the fuel efficiency and to suppress the PN by the weak stratified charge combustion. Further, the split injection interval may be set by determining whether the injection amount is in the full-lift condition or the half-lift condition when the injection amount is calculated by the CPU 501. As a result, since the split injection interval can be appropriately determined, the PN suppression effect is improved.

In a condition of a cold start or a high-rotation/high-load, the necessity of the multi-stage injection is high and a minute injection amount is further obtained. Since an unburned gas increases in temperature and pressure during the propagation of the flame in the engine cylinder in the high-rotation/high-load condition, a knock is easily caused by the self-ignition before an ignition using the ignition plug attached into the cylinder. For this reason, the multi-stage injection is highly required and a further minute injection amount is obtained. When the multi-stage injection is performed in the compression stroke of the piston in order to suppress the knock, the split injection interval can be reduced by the fuel injection in the half-lift condition. Accordingly, the high-temperature air-fuel mixture is cooled by the intake cooling effect using the fuel injection at an appropriate timing and thus the knock suppression effect is improved.

Further, the fuel injection may be divided in the half-lift condition during the compression stroke while the injection amount necessary for the combustion is ensured using the fuel injection in the full-lift condition during the intake stroke. Since the intake air flows large during the intake stroke, it is possible to form the uniform air-fuel mixture by injecting a large amount of the fuel. Further, the injection pulse in the full-lift condition may be adjusted so that the fuel injection is performed in the half-lift during the compression stroke by saving an injection amount necessary for one combustion cycle using the fuel injection in the full-lift condition. As a result, since it is possible to reliably inject the fuel in the half-lift condition during the compression stroke, the knock suppression effect can be improved. Further, since the rich air-fuel mixture is formed only in the vicinity of the ignition plug by the minute injection in the half-lift condition during the compression stroke, it is possible to obtain an effect of obtaining high fuel efficiency and reducing the PN by realizing the weak stratified charge combustion.

Further, since the fuel injection amount is small in the half-lift condition, the flow rate of the fuel injected from the injection hole 219 is slow and the fuel spray arrival distance is small compared to the full-lift condition. The flow rate of the sprayed fuel is dependent on the passage cross-sectional area of the seat of the valve seat 218 and the valve body 214 and the flow rate of the fuel decreases as the maximum height position of the valve body 214 decreases. Since the piston moves to the top center during the compression stroke, a distance between the surface of the piston and the injection hole 219 of the fuel injection device becomes shorter as it becomes the late compression stroke. Accordingly, the sprayed fuel easily adheres to the piston and the PN increases. When the injection amount in the half-lift is set to be smaller, that is, the first drive current application time is set to be shorter as it becomes the late compression stroke, it is possible to suppress the knock and the PN.

REFERENCE SIGNS LIST

101A to 101D, 540 fuel injection device
103 drive circuit
104 engine control unit (ECU)
150 drive device
202 needle
205 solenoid
207 fixed core
210 first spring
212 zero spring (second spring)
234 third spring
214 valve body
218 valve seat
220 intermediate member
232 cap
501 CPU 501

The invention claimed is:

1. A drive device for a fuel injection device including a valve body, a valve seat portion having a seat surface on which the valve body sits, a needle driving the valve body, and a coil driving the needle by a drive current flowing thereto, the drive device for the fuel injection device comprising:

a control unit configured to control a drive voltage or a drive current applied to the coil, wherein the control unit is configured to control a height position of the valve body to be in a height position region lower than a maximum height position by decreasing the drive current flowing to the coil from a maximum drive current to a first drive current lower than the maximum drive current and changing a first drive current application time; and wherein the control unit is configured to control the valve body so that the valve body reaches the maximum height position by decreasing the drive current flowing to the coil from the maximum drive current to the first drive current before the needle contacts the valve body, and then decreasing the drive current to a second drive current lower than the first drive current.

2. The drive device for the fuel injection device according to claim 1, wherein the control unit is configured to keep the drive current above the first drive current during a period in which the control unit decreases the drive current from the maximum drive current while controlling the valve body so that the valve body reaches the maximum height position.

3. The drive device for the fuel injection device according to claim 1, wherein the control unit is configured to control the height position of the valve body in the height position region lower than the maximum height position so that the height position becomes higher as the first drive current application time becomes longer.

4. The drive device for the fuel injection device according to claim 1, wherein the control unit is configured to control a time in which the valve body is located at the maximum height position by changing a second drive current application time.

5. The drive device for the fuel injection device according to claim 1, wherein the needle is disposed to have a gap with respect to the valve body in an axial direction while the valve body sits on the seat surface and contacts the valve body in the axial direction while the gap disappears and the valve body is pressed up in a direction opposite to the valve seat portion to control the fuel injection device.

6. The drive device for the fuel injection device according to claim 1, wherein the control unit is configured to control the valve body so that the valve body reaches a height position lower than the maximum height position by decreasing the drive current flowing to the coil from the maximum drive current to the first drive current lower than the maximum drive current and then interrupting the drive current.

7. The drive device for the fuel injection device according to claim 1, wherein the control unit is configured to control the first drive current application time by repeatedly allowing and not allowing the application of voltage to the coil so that the height position of the valve body at the height position region lower than the maximum height position is controlled.

8. The drive device for the fuel injection device according to claim 1, wherein the control unit is configured to control a second drive current application time by repeatedly allowing and not allowing the application of voltage to the coil so that a time in which the valve body is located at the maximum height position is controlled.

9. The drive device for the fuel injection device according to claim 1, wherein the control unit is configured to control the first drive current application time so that the first drive current application time becomes short when a pressure of a rail disposed at an upstream side of the fuel injection device is a set value or less and controls the first drive current application time so that the first drive current application time becomes long when the pressure of the rail is the set value or more.

10. The drive device for the fuel injection device according to claim 1, wherein the control unit is configured to decrease a target value of the first drive current when battery voltage is continuously applied for a set time or a switching of a switch allowing and not allowing the application of the battery voltage is not performed for a set time.

11. The drive device for the fuel injection device according to claim 1, wherein the control unit is configured to increase a target value of the first drive current when a pressure of a fuel pipe disposed at an upstream side of the fuel injection device is a set value or more.

12. A drive device for a fuel injection device including a valve body, a valve seat portion having a seat surface on which the valve body sits, a needle driving the valve body, a fixed piece disposed to face the needle, and a coil driving the needle by a drive current flowing thereto, the drive device for the fuel injection device comprising:

a control unit which is configured to control the needle so that the needle reaches a height position lower than a facing surface of the fixed piece by decreasing the drive current flowing to the coil from a maximum drive current to a first drive current lower than the maximum drive current, and wherein the control unit is configured to control the needle so that the needle collides with the fixed piece by decreasing the drive current flowing to the coil from the maximum drive current to the first drive current before the needle collides with the fixed piece and then decreasing the drive current to a second drive current lower than the first drive current.

13. The drive device for the fuel injection device according to claim 12, wherein the control unit is configured to control the height position of the needle at a height position region lower than the facing surface of the fixed piece by changing a first drive current application time.

14. The drive device for the fuel injection device according to claim 12, wherein the control unit is configured to control a time in which the needle contacts the fixed piece by changing a second drive current application time.

15. The drive device for the fuel injection device according to claim 12, wherein the control unit is configured to control the needle so that the needle reaches the height position lower than the facing surface of the fixed piece by decreasing the drive current flowing to the coil from the maximum drive current to the first drive current lower than the maximum drive current and then interrupting the drive current.

16. A drive device for a fuel injection device including a valve body, a valve seat portion having a seat surface on which the valve body sits, a needle driving the valve body, a fixed piece disposed to face the needle, and a coil driving the needle by a drive current flowing thereto, the drive device for the fuel injection device controlling an injection amount of the fuel injection device comprising:

a control unit which is configured to control the needle so that the needle reaches a height position lower than a facing surface of the fixed piece by decreasing the drive current flowing to the coil from a maximum drive current to a first drive current lower than the maximum drive current when fuel is injected in a first injection amount region; and wherein the control unit is configured to control the needle so that the needle collides with the fixed piece by decreasing the drive current flowing to the coil from the maximum drive current to the first drive current lower than the maximum drive current before the needle collides with the fixed piece and then decreasing the drive current to a second drive current lower than the first drive current when fuel is injected in a second injection amount region having an injection amount larger than that of the first injection amount region.

17. The drive device for the fuel injection device according to claim 1, wherein a fuel injection for one combustion cycle is divided and the first drive current application time is shortened as it becomes a subsequent stage of a compression stroke after an initial stroke.

* * * * *